US005251592A

United States Patent [19]

Seki et al.

[11] Patent Number: 5,251,592

[45] Date of Patent: Oct. 12, 1993

[54] ABNORMALITY DETECTION SYSTEM FOR EVAPORATIVE FUEL CONTROL SYSTEMS OF INTERNAL COMBUSTION ENGINES

[75] Inventors: Yasunari Seki; Shigetaka Kuroda; Kazutomo Sawamura; Masatoshi Udagawa; Youichi Iwata; Takushi Toda, all of Wako, Japan

[73] Assignee: Honda Giken Kogyo Kabushiki Kaisha, Tokyo, Japan

[21] Appl. No.: 831,029

[22] Filed: Feb. 4, 1992

[30] Foreign Application Priority Data

Feb. 20, 1991 [JP] Japan ..... 3-047689
Feb. 20, 1991 [JP] Japan ..... 3-047690
Feb. 20, 1991 [JP] Japan ..... 3-047691

[51] Int. Cl.[5] ..... F02B 77/00; F02M 33/02
[52] U.S. Cl. ..... 123/198 D; 123/520
[58] Field of Search ..... 123/198 D, 516, 518, 123/519, 520, 521

[56] References Cited

U.S. PATENT DOCUMENTS 4,949,695 8/1990 Uranishi et al. .
4,962,744 10/1990 Uranishi ..... 123/519
5,085,197 2/1992 Mader ..... 123/520
5,099,439 3/1992 Saito ..... 123/520
5,113,834 5/1992 Aramaki ..... 123/198 D
5,139,001 8/1992 Tada ..... 123/520

FOREIGN PATENT DOCUMENTS 57-137633 8/1982 Japan .
63-189639 8/1988 Japan .

*Primary Examiner*—Carl S. Miller
*Attorney, Agent, or Firm*—Nikaido, Marmelstein, Murray & Oram

[57] ABSTRACT

An abnormality detection system is provided, which detects abnormality in an evaporative fuel control system for an internal combustion engine. A plurality of temperature sensors are arranged in an evaporative fuel storage device at different locations for detecting the temperature of an adsorbent or in the vicinity thereof within the storage device at the different locations. An ECU controls at least one of charging of evaporative fuel from the fuel tank to the storage device and purging of evaporative fuel from the storage device to the intake system of the engine. The ECU determines the presence or absence of an abnormality in the evaporative fuel control system, based upon output values from the temperature sensors assumed when the control system is operative. A state in which adsorption of evaporative fuel generated in the fuel tank to the adsorbent of the storage device has been completed is detected, based upon the amount of a rise in temperature detected while the charging is being effected. The ECU effects the abnormality determination after the state has been detected. The system may be applied to an internal combustion engine in which the air-fuel ratio is controlled by the use of an air-fuel ratio correction coefficient determined in response to an output from an air-fuel ratio sensor.

17 Claims, 17 Drawing Sheets

ABNORMALITY DETECTION SYSTEM FOR EVAPORATIVE FUEL CONTROL SYSTEMS OF INTERNAL COMBUSTION ENGINES

BACKGROUND OF THE INVENTION

1. Field of the Invention

This invention relates to an abnormality detection system for detecting abnormalities in evaporative fuel control systems of internal combustion engines which temporarily store evaporative fuel generated in the fuel tank in a canister thereof and discharge same into the intake system of the engine.

2. Prior Art

The temperature inside of a canister of an evaporative fuel control system rises as evaporative fuel is stored into the canister (hereinafter called "charging"), due to heat of adsorption, while the former lowers as the latter is discharged into the intake system (hereinafter called "purging"). There has been proposed an abnormality detecting system for evaporative fuel control systems, which makes use of the above fact, by U.S. Pat. No. 4,949,695. This proposed system includes a temperature sensor arranged in the canister, and calculates the difference (temperature drop amount) between the maximum temperature inside the canister assumed during stoppage of the vehicle when charging is effected and the minimum temperature inside the canister assumed during running of the vehicle when purging is effected, and compares the calculated difference with a predetermined value, to determine whether there is an abnormality in the evaporative fuel control system, based upon the result of the comparison.

According to the proposed system, the temperature inside the canister is detected at a single point. However, the location within the canister at which the temperature changes with charging, varies depending upon the charged amount. As a result, the charging state of the canister cannot be accurately grasped such that abnormality detection cannot be accurately effected. Particularly, when evaporative fuel is charged into the canister at a small flow rate or the concentration of evaporated fuel charged is low, it cannot be discriminated whether a change in the detected temperature inside the canister is caused by a change in the ambient temperature or due to heat of adsorption of evaporative fuel, which makes it impossible to make an accurate detection of abnormality.

Further, the proposed system makes it a prerequisite that charging should be effected during stoppage of the vehicle and purging during running of the vehicle, to carry out an abnormality detection depending upon the result of comparison of the temperature difference with the predetermined value. Therefore, it cannot start the abnormality detection until after the vehicle has run over a time period (e.g. 30 minutes) elapses, which is required for the temperature inside the canister to lower to a sufficient extent if purging is positively effected while no abnormality exists. Thus, it takes a long time to obtain a result of the abnormality detection.

Still further, during stoppage of the vehicle, the amount of evaporative fuel charged into the canister largely varies depending on the fuel amount, pressure, and temperature within the fuel tank. Therefore, if an abnormality detection is carried out by starting purging when the charged amount within the canister does not reach yet a sufficient level, there is a possibility of an erroneous judgement that an abnormality exists even when the evaporative fuel control system is normally functioning.

On the other hand, there is widely known an air-fuel ratio control system which determines an air-fuel ratio correction coefficient in response to an air-fuel ratio signal from an air-fuel ratio sensor arranged in the exhaust system of an internal combustion engine, and controls the amount of fuel supplied to the engine by the use of the determined correction coefficient. If evaporative fuel is purged into the intake system during operation of the air-fuel ratio control system, the value of the air-fuel ratio correction coefficient changes due to enriching of the air-fuel ratio of a mixture supplied to the engine. An abnormality detecting method for detecting an abnormality in the evaporative fuel control system has been proposed, which makes use of the above fact, by Japanese Patent Application No. 2-207914 filed by the assignee of the present application. According to this proposed method, after the engine has been warmed up when the engine temperature exceeds a predetermined value, the value of the air-fuel ratio correction coefficient is determined as a first value thereof during stoppage of purging, and also determined as a second value thereof during purging, and the first and second values are compared with each other. An abnormality detection is effected based upon the comparison result.

The proposed method makes it a precondition that the canister is fully charged with evaporative fuel (evaporative fuel is fully adsorbed within the canister) immediately before purging is started. More specifically, in this method, the above precondition is assumed to be satisfied when the engine and the vehicle on which the engine is installed have continued a steady operating condition and a steady running condition, respectively, over a predetermined time period after completion of warming-up of the engine, and then the second value of the air-fuel ratio correction coefficient is determined to effect an abnormality detection.

However, for example, when evaporative fuel is not fully generated within the fuel tank, the canister is not fully charged even after the steady conditions have continued over the predetermined time period. If an abnormality detection is effected on such an occasion, there is a possibility of an erroneous judgement that there is an abnormality in the evaporative fuel control system, though no fault exists in actuality.

SUMMARY OF THE INVENTION

It is an object of the invention to provide an abnormality detection system which is capable of accurately grasping a charged state within the canister, and carrying out an accurate abnormality detection even when an insufficient amount of evaporative fuel is generated and hence the charged amount is small within the canister.

A further object of the invention is to accurately grasp a charged state within the canister and accurately determining the timing of starting abnormality detection to thereby start abnormality detection at an early timing.

To attain the first-mentioned object, the present invention provides an abnormality detection system for detecting abnormality in an evaporative fuel control system for an internal combustion engine having a fuel tank, and an intake system, the evaporative fuel control system having an evaporative fuel storage device accommodating an adsorbent for adsorbing evaporative fuel generated in the fuel tank.

The abnormality detection system according to the invention is characterized by an improvement comprising:

a plurality of temperature sensors arranged in the evaporative fuel storage device at different locations for detecting the temperature of the absorbent or in the vicinity thereof within the evaporative fuel storage device at the different locations;

evaporative fuel control means for controlling at least one of charging of the evaporative fuel from the fuel tank to the evaporative fuel storage device and purging of the evaporative fuel from the evaporative fuel storage device to the intake system of the engine; and abnormality determining means for determining whether or not there is an abnormality in the evaporative fuel control system, based upon output values from the temperature sensors assumed when the evaporative fuel control system is operative.

In a specific form, the abnormality detection system includes charging control means for effecting the charging when the evaporative fuel is generated in the fuel tank, and wherein the abnormality determining means effects the abnormality determination, based upon the output values from the temperature sensors assumed when the changing is being effected.

Further, the abnormality detection system includes purging detecting means for detecting whether or not the purging is being effected, and wherein the abnormality determining means effects the abnormality determination, based upon the output values from the temperature sensors assumed when the purging is being effected.

To attain the second-mentioned object, the present invention provides an abnormality detection system for detecting abnormality in an evaporative fuel control system for an internal combustion engine having a fuel tank, and an intake system, the evaporative fuel control system having an evaporative fuel storage device accommodating an adsorbent for adsorbing evaporative fuel generated in the fuel tank, purging control means for purging the evaporative fuel from the evaporative fuel storage device to the intake system, temperature detecting means for detecting temperature of the adsorbent or for the vicinity thereof within the evaporative fuel storage device. The abnormality detection system includes abnormality determining means for effecting determination of abnormality in the evaporative fuel control system, based upon an amount of drop in the temperature detected by the temperature detecting means when the purging is being effected by the purging control means.

The abnormality detection system is characterized by an improvement comprising:

adsorption completion-detecting means for detecting a state in which adsorption of the evaporative fuel generated in the fuel tank to the adsorbent of the evaporative fuel storage device has been completed, based upon an amount of rise in the temperature detected by the temperature detecting means while the charging is being effected.

The abnormality determining means effects the abnormality determination after the state has been detected by the adsorption completion-detecting means.

Preferably, the temperature detecting means comprises a plurality of temperature sensors arranged at different locations within the evaporative fuel storage device for detecting the temperature of the adsorbent or in the vicinity thereof at the different locations, the adsorption completion-detecting means detecting completion of the adsorption of the evaporative fuel, based upon amounts of rise in temperatures detected respectively by the temperature sensors while the charging is being effected.

Also preferably, the temperature detecting means comprises a plurality of temperature sensors arranged at different locations within the evaporative fuel storage device for detecting the temperature of the adsorbent or in the vicinity thereof at the different locations, the abnormality determining means effecting the abnormality determination, based upon amounts of rise in temperatures detected respectively by the temperature sensors while the purging is being effected.

To attain the second-mentioned object, the present invention also provides an abnormality detection system for determining abnormalities in an evaporative fuel control system for an internal combustion engine having an exhaust system, an intake system, an air-fuel ratio sensor arranged in the exhaust system, fuel supply control means responsive to an output from the air-fuel ratio sensor for determining a value of an air-fuel ratio correction coefficient and controlling an amount of fuel supplied to the engine based upon the determined value of the air-fuel ratio correction coefficient, and a fuel tank, the evaporative fuel control system having an evaporative fuel storage device accommodating an absorbent for absorbing evaporative fuel generated in the fuel tank, and purging control means for purging the evaporative fuel from the evaporative fuel storage device to the intake system, the abnormality detection system including abnormality determining means for effecting determination of abnormality in the evaporative fuel control system, based upon the value of the air-fuel ratio connection coefficient determined when the purging is being effected by the purging control means.

The abnormality detection system is characterized by an improvement comprising:

temperature detecting means for detecting temperature of the adsorbent or in the vicinity thereof within the evaporative fuel storage device; and abnormality determination-starting means for causing the abnormality determining means to start the abnormality determination, when an amount of rise in the temperature detected by the temperature detecting means is greater than a predetermined value.

Preferably, the evaporative fuel control system includes charging control means for effecting charging of the evaporative fuel from the fuel tank to the evaporative fuel storage device when the evaporative fuel is generated in the fuel tank, the abnormality determination-starting means causing the abnormality determining means to start the abnormality determination when the amount of rise in the temperature detected by the temperature detecting means is greater than the predetermined while the charging is being effected by the charging control means.

Also preferably, the temperature detecting means comprises a plurality of temperature sensors arranged at different locations within the evaporative fuel storage device for detecting the temperature of the adsorbent or in the vicinity thereof at the different locations within the evaporative fuel storage device, the abnormality determination-starting means determining timing of starting the abnormality determination, based upon temperature values detected by the temperature sensors, amounts of rise in the temperature values, and a difference between the temperature values.

Preferably, the abnormality determining means calculates an average value of the air-fuel ratio correction coefficient when the purging is not being effected, causes the purging control means to start the purging when the engine is in a predetermined steady operating condition, and judges that there is an abnormality in the evaporative fuel control system, when the value of the air-fuel ratio correction coefficient determined while the purging is being effected has continously been greater than a value obtained by subtracting a correction value equivalent to an amount of the purging from the average value of the air-fuel ratio correction coefficient, over a predetermined time period.

The above and other objects, features, and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
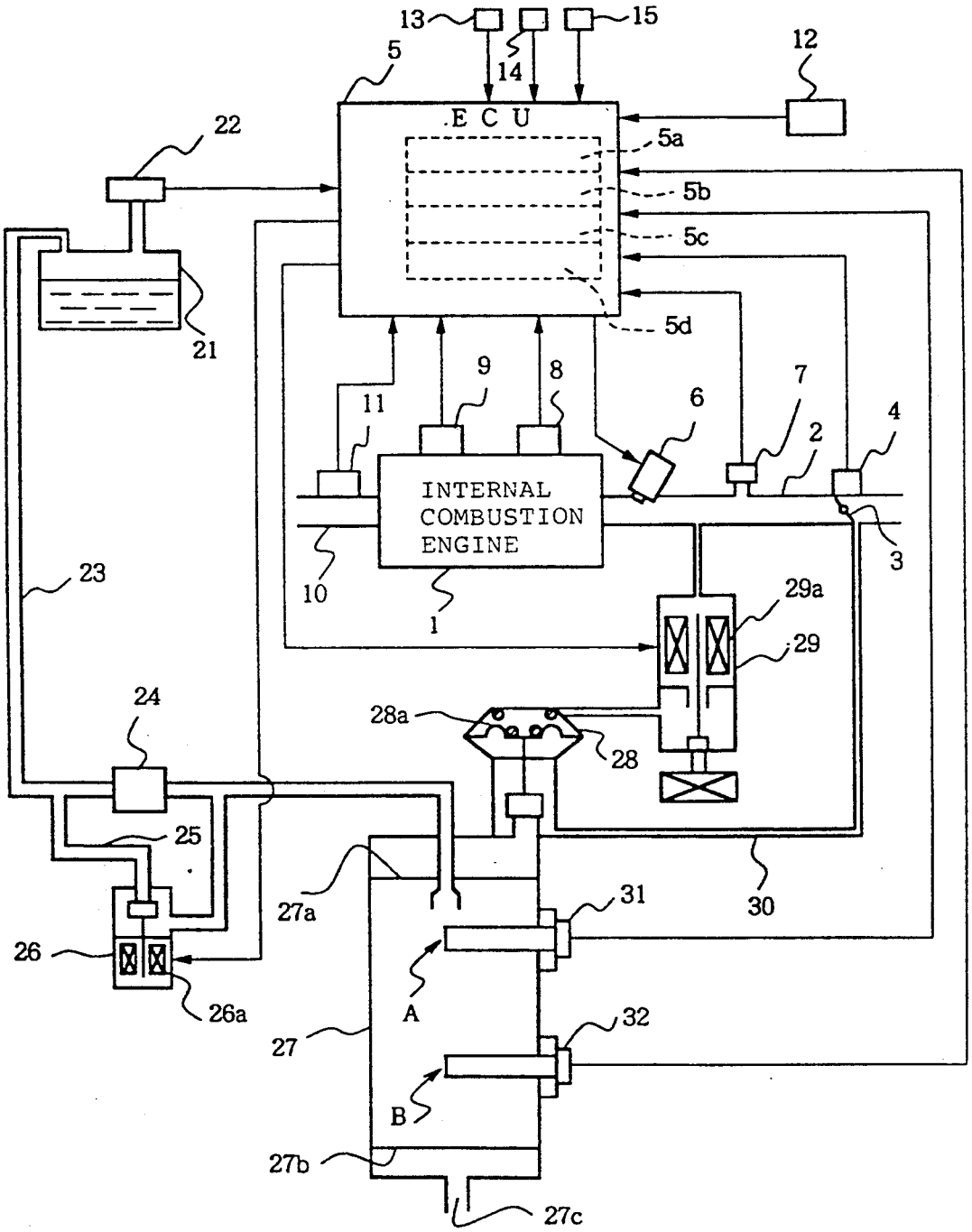
FIG. 1 is a block diagram showing the whole arrangement of an evaporative fuel control system for an internal combustion system, including an abnormality detection system according to the invention.

Referring first to FIG. 1, there is illustrated the whole arrangement of an evaporative fuel control system of an internal combustion engine, including an abnormality detection system according to the invention. In the figure, reference numeral 1 designates an internal combustion engine for automotive vehicles. The engine is a four-cylinder type, for instance. Connected to the cylinder block of the engine 1 is an intake pipe 2 in which is arranged a throttle valve 3. A throttle valve opening ($\theta_{TH}$) sensor 4 is connected to the throttle valve 3 for generating an electrical signal indicative of the sensed throttle valve opening and supplying same to an electronic control unit (hereinafter called "the ECU") 5.

Fuel injection valves 6, only one of which is shown, are inserted into the interior of the intake pipe 2 at locations intermediate between the cylinder block of the engine 1 and the thottle valve 3 and slightly upstream of respective intake valves, not shown. The fuel injection valves are connected to a fuel tank 21 via a fuel pump, not shown, and electrically connected to the ECU 5 to have their valve openings periods controlled by signals therefrom.

On the other hand, an intake pipe absolute pressure (PBA) sensor 7 is provided in communication with the interior of the intake pipe 2 at a location immediately downstream of the throttle valve 3 for supplying an electrical signal indicative of the sensed absolute pressure within the intake pipe 2 to the ECU 5.

An engine rotational speed (Ne) sensor 8 and a cylinder-discriminating (CYL) sensor 9 are arranged in facing relation to a camshaft or a crankshaft of the engine 1, not shown. The engine rotational speed sensor 8 generates a pulse as a TDC signal pulse at each of predetermined crank angles whenever the crankshaft rotates through 180 degrees, while the cylinder-discriminating sensor 9 generates a pulse at a predetermined crank angle of a particular cylinder, the pulses from these sensors being supplied to the ECU 5.

An $O_2$ sensor 13 as an air-fuel ratio sensor is mounted in an exhaust pipe 10 connected to the cylinder block of the engine 1, for sensing the concentration of oxygen present in exhaust gases emitted from the engine 1 and supplying an electrical signal indicative of a detected value VO2 of the oxygen concentration to the ECU 5.

A tank internal pressure sensor 22 is provided in communication with an upper space in the fuel tank 21 which has an enclosed body, for sensing pressure within the fuel tank 21 and supplying an electrical signal indicative of the sensed pressure to the ECU 5. Connected to the ECU 5 are a vehicle speed sensor 12 for sensing the running speed V of a vehicle, not shown, on which the engine 1 is installed, an electrical load switch sensor 13 for detecting whether operating switches of electrical devices forming load on the engine such as headlamps are on or off, an air conditioner switch sensor 14 for sensing whether an air conditioner of the vehicle is on or off, and a brake switch sensor 15 for sensing whether a brake switch which turns on when a brake of the vehicle is operated is on or off, output signals from these sensors being supplied to the ECU 5.

The upper space in the fuel tank 21 is connected to a canister (evaporative fuel storage device) 27 via a conduit 23 across which is arranged a two-way valve 24.

The valve 24 is bypassed by a conduit 25 across which is arranged a pressure control valve 26 which has a solenoid 26a electrically connected to the ECU 5 to be controlled by a signal therefrom. The pressure control valve 26 is a normally-closed type, i.e. when the solenoid 26a is energized, the valve 26 is open to open the passage 25, while the former is deenergized, the latter is closed to block the passage 25.

The canister 27 is connected to the interior of the intake pipe 2 via a purge cut valve 28 and a conduit 30. The conduit 30 has an end opening into the intake pipe 2 at a location corresponding to a fully closed position of the throttle valve 3. The purge cut valve 28 has a vacuum chamber 28a connected to a purge control valve 29 such that when a solenoid 29a of the purge control valve 29 is energized, the vacuum chamber 28a is communicated with the atmosphere, while when the solenoid 28a is deenergized, the vacuum chamber 28a is communicated with the interior of the intake pipe 2 at a location downstream of the throttle valve 3. The solenoid 29a is electrically connected to the ECU 5 to be controlled by a signal therefrom.

The canister 27 comprises a retainer plate 27a having a multiplicity of small holes formed therein, a filter 27b for filtering fresh air introduced into the canister 27, an air inlet 27c, and first and second temperature sensors 31, 32. An adsorbent 27d is filled between the retainer plate 27a and the filter 27b. The conduit 23 extending from the fuel tank 21 has an end thereof opening into the absorbent at a location in the vicinity of the retainer plate 27a. The first temperature sensor 31 is disposed to sense temperature at a point A in the vicinity of the open end (first opening) of the conduit 23, while the second sensor 32 is disposed to sense temperature at a point B in the vicinity of the air inlet 27c (second opening) of the filter 27b. The temperature sensors 31, 32 are electrically connected to the ECU 5 to supply same with output signals thereof.

The evaporative fuel control system is formed by the above-mentioned elements 21–30 and operates as follows:

The two-way valve 24 opens when the pressure difference between opposites ends thereof (the difference between pressure on the fuel tank 21 side and pressure on the canister 27 side) exceeds a predetermined value, and closes when the former is below the latter. Thus, when the pressure control valve 26 is closed, the two-way valve 24 opens if the pressure within the fuel tank 21 rises such that the above pressure difference exceeds the predetermined value, whereby evaporative fuel from the fuel tank 21 flows into the canister 27 through the open two-way valve 24 to be adsorbed by the adsorbent and stored therein (i.e. the canister 27 is charged). When the pressure control valve 26 is open, the canister 27 can be charged even when evaporative fuel is produced within the fuel tank 21 in small quantities.

When the purge control valve 29 is communicated with the atmosphere (when the solenoid 29a is energized), the purge cut valve 28 is closed to stop purging. On the other hand, when the purge control valve 29 is communicated with the intake pipe 2 (when the solenoid 29a is deenergized), the purge cut valve 28 is open so that evaporative fuel stored in the canister 27 is drawn into the intake pipe 2 together with fresh air introduced through the air inlet 27c (i.e. purging is effected). Incidentally, when the vacuum within the intake pipe 2 is not so high, purging does not take place even if the purge cut valve 28 is open.

As vacuum is developed within the fuel tank 21 when the latter is cooled by ambient air etc, the two-way valve 24 opens so that evaporative fuel charged in the canister 27 is returned to the fuel tank 21 through the open valve 24 (provided that the pressure control valve 26 is closed).

The ECU 5 comprises an input circuit 5a having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5b which carries out failure-detecting programs, referred to hereinafter, etc., memory means 5c storing various operational programs which are executed in the CPU 5b, etc. and for storing results of calculations therefrom, etc., and an output circuit 5d which outputs driving signals to the fuel injection valves 6, the pressure control valve 26, and the purge control valve 29.

The CPU 5 operates in response to the above-mentioned engine operating parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 6 are to be opened, by the use of the following equation in synchronism with inputting of TDC signal pulses to the ECU 5.

$$TOUT = Ti \times K1 \times KO2 + K2 \quad (1)$$

where Ti represents a basic value of the fuel injection period TOUT of the fuel injection valves 6, which is read from a Ti map stored in the memory means 5c and set in accordance with the engine rotational speed Ne and the intake pipe absolute pressure PBA.

KO2 represents an air-fuel ratio feedback correction coefficient whose value is determined in response to the oxygen concentration in the exhaust gases detected by the $O_2$ sensor 13, during air-fuel ratio feedback control, while it is set to respective predetermined appropriate values while the engine is in predetermined operating regions (the open-loop control regions) other than the feedback control region. The correction coefficient KO2 is calculated in the following manner: The output level of the $O_2$ sensor 13 is compared with a predetermined reference value. When the output level is inverted with respect to the predetermined reference value, the correction coefficient KO2 is calculated by a known proportional control method by addition of a proportional term (P-term) to the KO2 value, whereas when the former remains uninverted, it is calculated by a known integral control method by addition of an integral term (I-term) to the KO2 value. The manner of calculation of the correction coefficient KO2 is disclosed in Japanese Provisional Patent Publications (Kokai) Nos. 57-137633 and 63-189639, etc.

K1 and K2 represent other correction coefficients and correction variables, respectively, which are calculated based on various engine operating parameter signals to such values as to optimize characteristics of the engine such as fuel consumption and accelerability depending on operating conditions of the engine.

The CPU 5b supplies through the output circuit 5d, the fuel injection valves 6 with driving signals corresponding to the calculated fuel injection period TOUT determined as above, over which the fuel injection valves are to be opened, as well as the pressure control valve 26 and the purge control valve 29 with respective driving signals.

As noted before, the abnormality detection system according to the invention is provided with two temperature sensors 31, 32 for sensing temperature at different points within the canister 27, on the following grounds. This will be explained in detail with reference to FIGS. 2–4.

Figure 2:
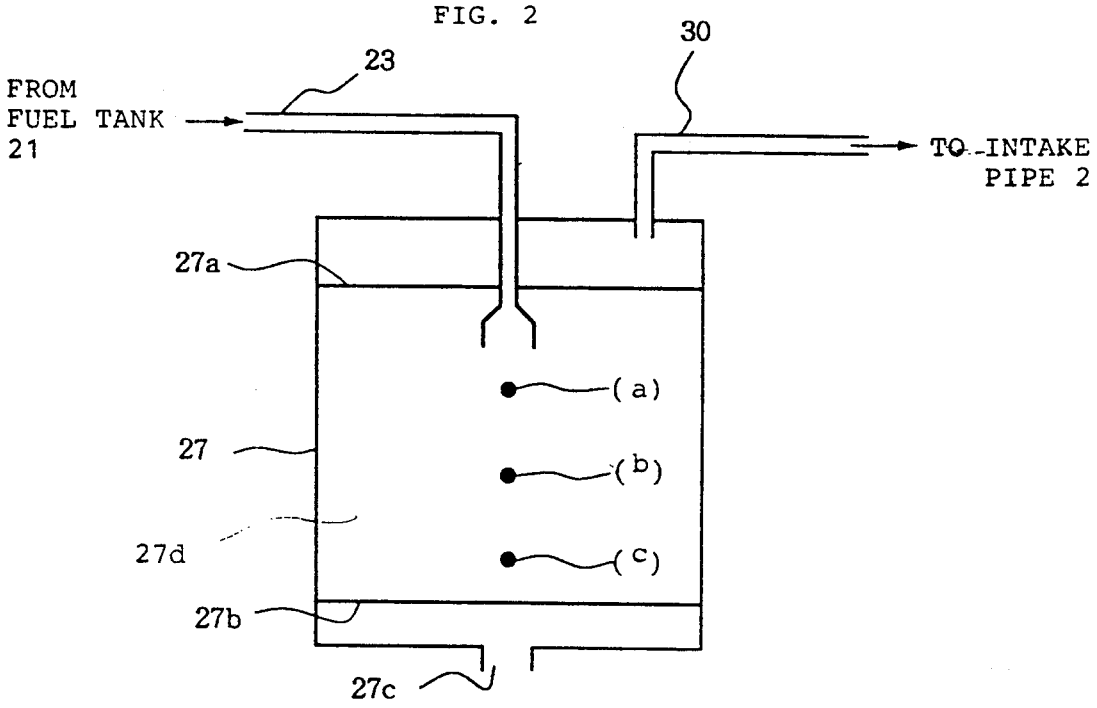
FIG. 2 is a schematic view showing temperature detecting points within a canister in FIG. 1.
Figure 3A:
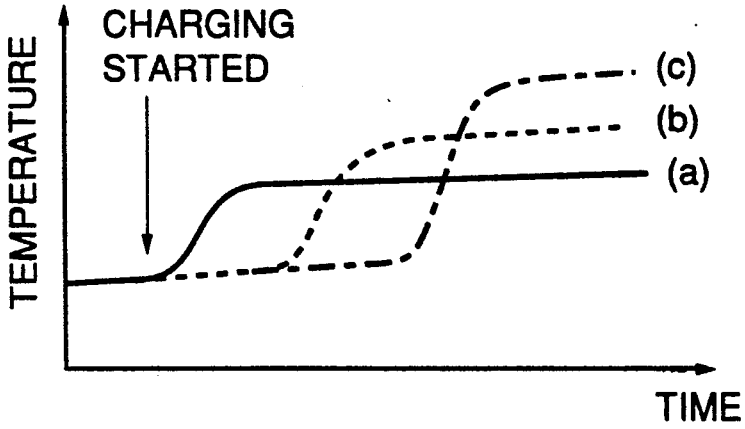
FIGS. 3(*a*), (*b*), and (*c*) are graphs showing changes in the temperatures at the points within the canister, with the lapse of time.
Figure 3B:
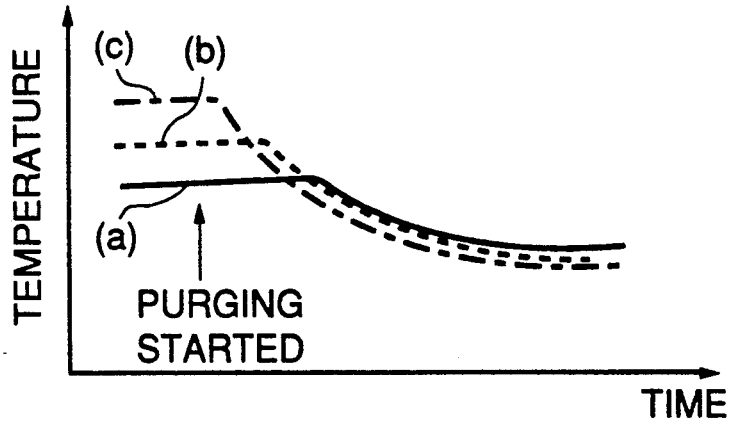
Figure 3C:
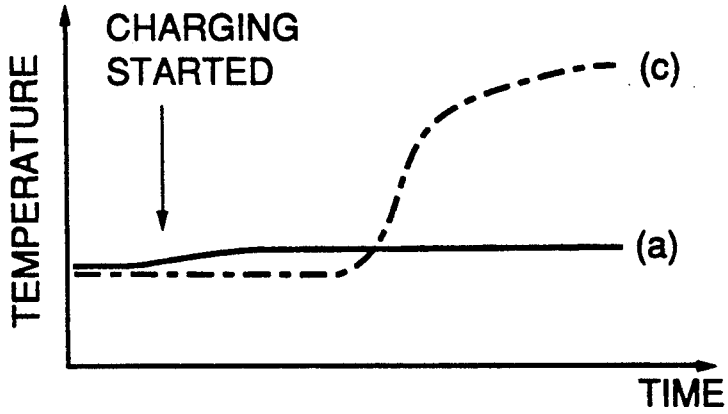

FIG. 2 schematically shows locations within the canister 27 at which the canister temperature is to be sensed, from which the temperature sensors 31, 32 and the purge cut valve 28 are omitted for the clarity of illustration. The temperatures at points (a), (b), and (c) in FIG. 2 change with the lapse of time as shown in FIGS. 3(*a*), (*b*) during charging and during purging, respectively. As seen in FIGS. 3(*a*), (*b*), during charging, the temperatures rise successively in the order from a location closer to the open end of the conduit 23 extending from the fuel tank 21 (the evaporative fuel-supply side) toward the air inlet 27*c*, whereas during purging the temperatures drop successively in the order from the air inlet 27*c* toward the open end of the conduit 23, in reverse to the charging.

Therefore, by monitoring a temperature at a certain single point, e.g. at the point (c), it can be determined whether charging has proceeded to the single point (c). However, the amount and gradient of change in the temperature become smaller as the charged amount (concentration and flow rate) of evaporative fuel is smaller. Therefore, in the case of single point detection, if the charged amount of evaporative fuel is small, it cannot be discriminated whether a change in the temperature at the single point has been caused by a change in the ambient temperature around the canister or by heat of adsorption. Therefore, according to the invention, the canister temperature is detected at two or more points, e.g. at the points (a), (c), and the detected temperature values are compared with each other to thereby grasp the charged state of the canister 27 more accurately.

Temperature transition from a fully or completely purged state where almost no evaporative fuel is stored in the canister is shown in FIG. 3(*a*). More specifically, first the temperature at the point (a) rises earlier than that at the point (c), which means that the canister zone around the point (a) has been charged, and thereafter the temperature at the point (c) rises. As charging further proceeds, the temperature at the point (c) further rises above that at the point (a), which means that the canister zone around the point (c) has been charged. By thus detecting the canister temperature at two or more points, it is possible to determine how far from the open end of the conduit 23 the canister 27 has been charged, i.e. the charged amount of evaporative fuel.

On the other hand, after the canister has been charged to some degree (e.g., to the point (a)) the temperature at the point (a) does not further rise even with further charging, whereas the temperature at the point (c) rises with further charging. Therefore, by comparing between temperature changes at both the points (a), (c), the charged state of the canister can be more accurately grasped as compared with the case where the canister temperature is detected at a single point. That is, for example, if the temperature at the point (a) alone is detected, which hardly changes in this case, there is a possibility of a misjudgement that charging is not normally effected.

The manner of detecting abnormality based upon the detected canister temperature according to the invention will be described.

In the case where one of the temperature detecting points is set at a location closer to the side of the canister at which charging and purging are effected (i.e. the point (a) in FIG. 2), if charging has proceeded only to the zone around the point (a), the temperature at the point (a) should drop after starting of purging if there is no failure in the evaporative fuel control system. Therefore, if the above temperature does not drop, it can be judged that there is a fault in the purging line (i.e. purge cut valve 28, purge control valve 29, and/or conduit 30).

On the other hand, as the zone around the point (a) is charged, the temperature at the point (a) should rise if there is no failure in the charging line (i.e. conduits 23, 25, and/or pressure control valve 26). Therefore, to determine abnormality in the charging line, first an output from the tank internal pressure sensor 2 which is provided to detect whether evaporative fuel is generated in the fuel tank is monitored. If evaporative fuel is generated in the fuel tank, the pressure control valve 26 is opened to positively enable forced charging of evaporative fuel from the fuel tank to the canister even if the evaporative fuel amount in the fuel tank is very small. If in this forced charging-enabling state the temperature at the point (a) does not show a rise, it can be judged that the charging line is faulty.

Figure 4:
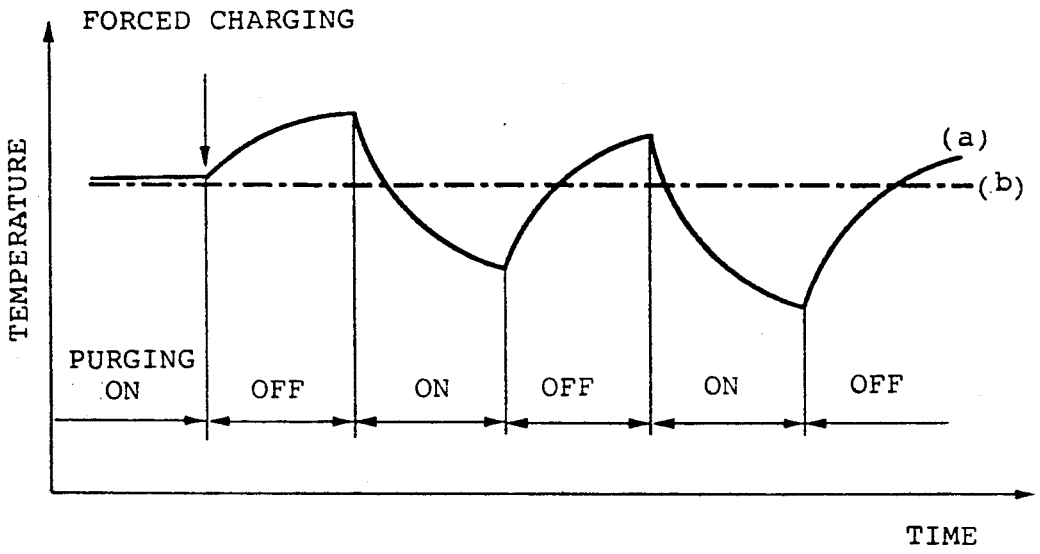
FIG. 4 is a graph showing changes in the temperatures at two points within the canister, responsive to purging and charging, with the lapse of time.

FIG. 4 shows changes in the temperatures at the points (a) and (c) with the lapse of time, which occur when the pressure control valve 26 is open and the purge cut valve 28 is repeatedly alternately opened (for purging) and closed (for interrupting purging) while a small amount of evaporative fuel (fuel vapor) is generated in the fuel tank with the canister being in a nearly fully purged state. It will be learned from FIG. 4 that even if a small amount of evaporative fuel is generated in the fuel tank with the canister being in a nearly fully purged state, it is possible to determine whether the canister is charged or purged, from the detected temperature at the point (a) during repeated alternate purging and interruption thereof. Even in this case, by comparing between temperatures detected at two or more points within the canister, such as points (a) and (c), changes in the temperature at the point (a) can be grasped with more accuracy.

By thus detecting temperatures at a plurality of points within the canister, it is possible to accurately grasp a charged state within the canister and hence accurately determine whether there is an abnormality in the evaporative fuel control system. Even when the canister is in a nearly fully purged state and evaporative fuel is generated in small quantities in the fuel tank, accurate abnormality detection can be carried out. This makes it possible to shorten or properly control the time period over which the canister is forcibly charged or the running distance over which the vehicle is made to run, thereby preventing deterioration of the canister due to overcharging, etc.

Figure 5:
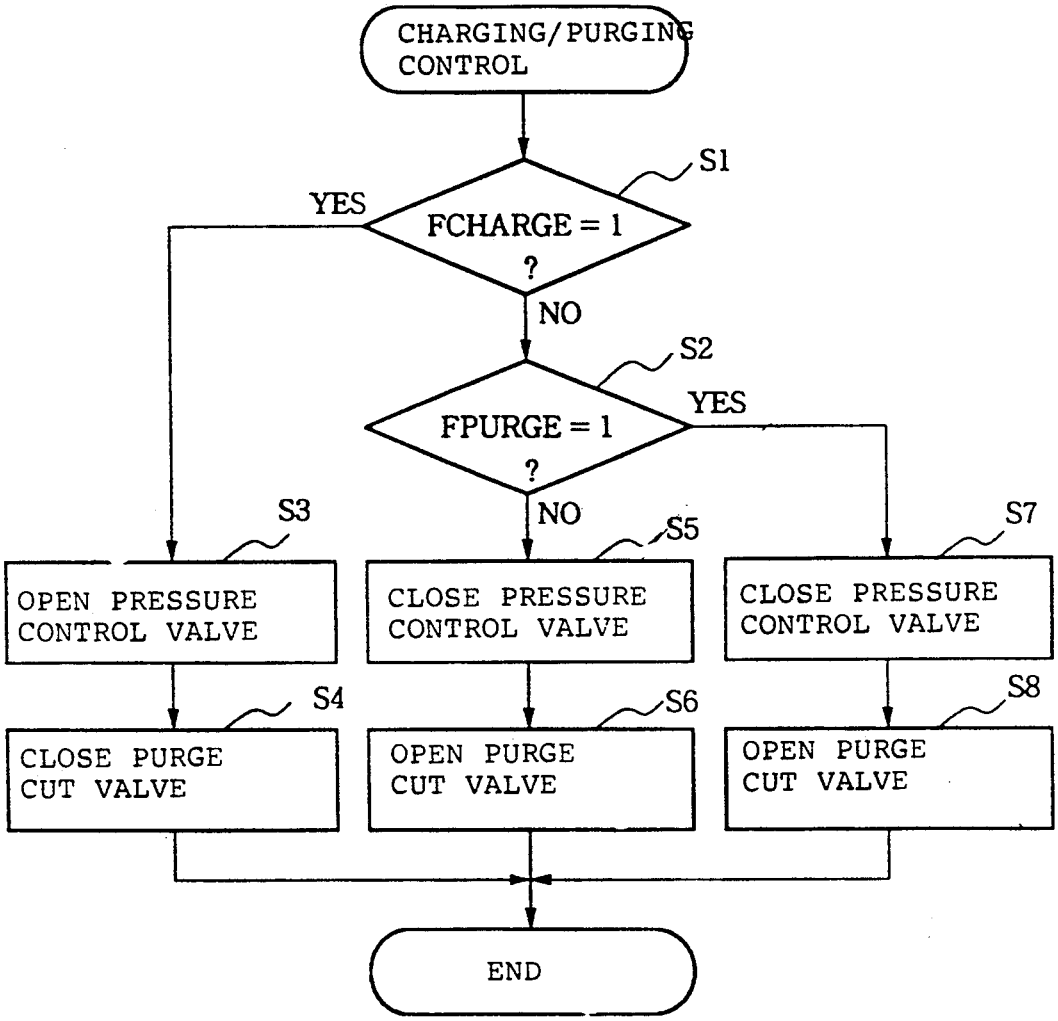
FIG. 5 is a flowchart showing a program for controlling a pressure control valve and a purge cut valve, according to a first embodiment of the invention.
Figure 6:
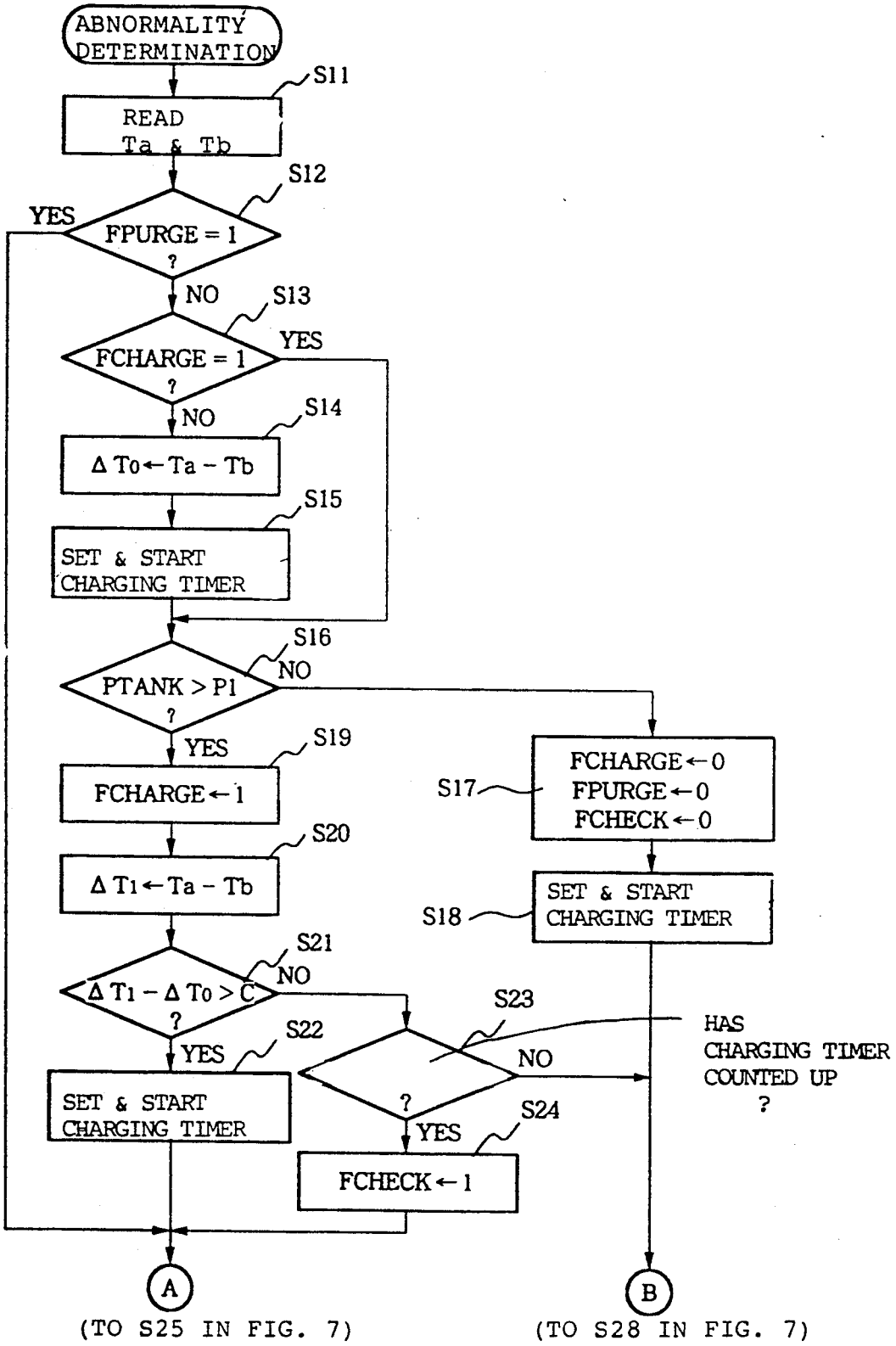
FIG. 6 is a flowchart showing a program for detecting abnormality according to the first embodiment.
Figure 7:
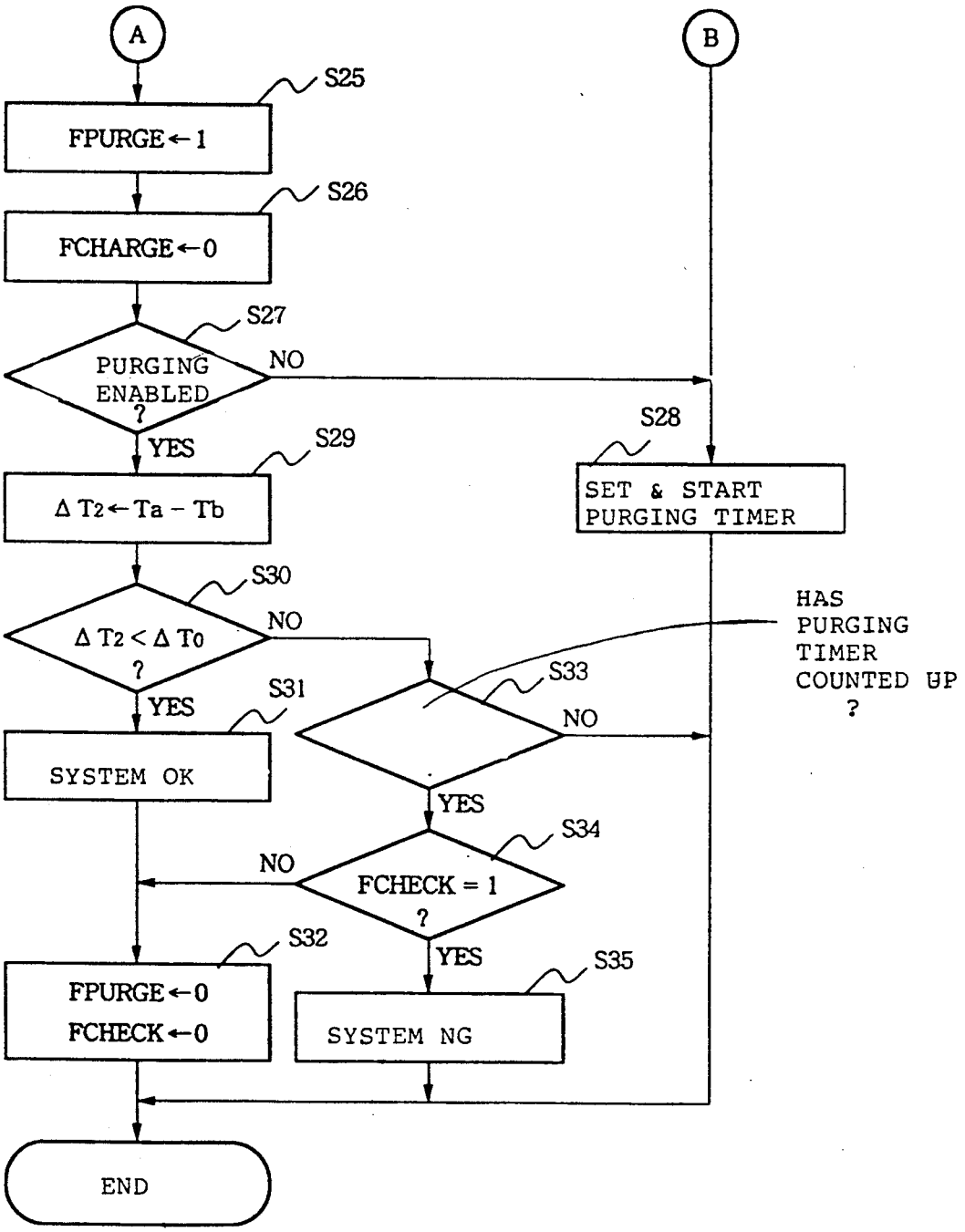
FIG. 7 is a similar flowchart continued from FIG. 6.

FIGS. 5–7 show programs for carrying out abnormality detection under a condition in which a small amount of evaporative fuel or fuel vapor is present in the canister (hereinafter simply called "by small fuel vapor") according to a first embodiment of the invention.

The program shown in FIG. 5 controls the pressure control valve 26 and the purge cut valve 28 in the following manner, in response to the values of a charging flag FCHARGE and a purging flag FPURGE which are set by the program shown in FIGS. 6 and 7, hereinafter referred to:

1) If FCHARGE=1 (if the answer to the question of a step S1 is affirmative or YES), the pressure control valve 26 is opened, and the purge cut valve 28 is closed (steps S3 and S4), whereby forced charging into the canister takes place.
2) If FCHARGE=0 (if the answer to the step S1 is negative or NO), the pressure control valve 26 is closed, and the purge cut valve 28 is opened, irrespective of the value of the flag FPURGE, whereby forced charging of a small amount of fuel vapor is interrupted to enable purging.

Figures 8A, 8B, 8C:
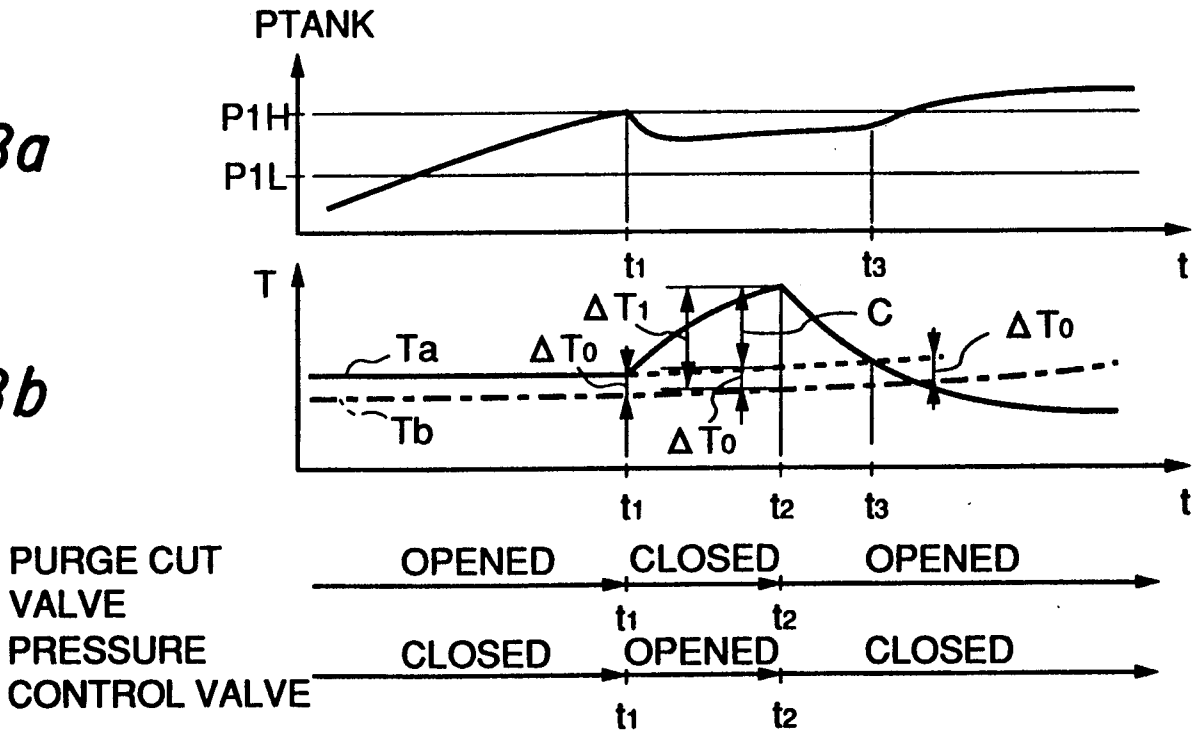
FIGS. 8(*a*), (*b*) and (*c*) are timing charts showing changes in pressure PTANK within a fuel tank, temperature T within the canister, and closing and opening of the purge cut valve and the pressure control valve.

The program of FIGS. 6 and 7 carries out abnormality detection with small fuel vapor. FIG. 8 shows the timing relationship between pressure PTANK detected by the tank internal pressure sensor 22, temperature values Ta, Tb detected by the first and second temperature sensors 31, 32, and closing and opening of the purge cut valve 28 and the pressure control valve 26. The program of FIGS. 6, 7 is executed in synchronism with generation of the TDC signal or at constant time intervals.

At a step S11 in FIG. 1, detected temperature values Ta, Tb from the first and second temperature sensors 31, 32 are read into the CPU 5*b*. At the next step S12, it is determined whether or not the purging flag FPURGE is equal to 0. The flag FPURGE is set to 1 when abnormality determination during purging can be effected. If the answer to the question of the step S12 is affirmative (YES), the program jumps to a step S27 in FIG. 7, whereas if the answer is negative (NO), it is determined at a step S13 whether or not the charging flag FCHARGE is equal to 1. The charging flag FCHARGE is set to 1 when forced charging is to be effected. If the answer to the step S13 is affirmative (YES), the program jumps to a step S16, whereas if the answer is negative (NO), a calculation is made of an initial value ΔT0 (=Ta−Tb) of the difference between the detected temperature values Ta, Tb from the first and second temperature sensors 31, 32, at a step S14. Then, a charging timer, which counts a time period elapsed after forced charging is started, is set to a predetermined time period tc and started, at a step S15. At the next step S16, it is determined whether or not the pressure PTANK within the fuel tank is higher than a predetermined value P1. The predetermined value P1 is provided with a hysteresis such that when the pressure PTANK is rising, it is set to a predetermined value P1H, while when the pressure PTANK is descending, it is set to a predetermined value P1L lower than P1H.

If the answer to the step S16 is negative (NO) (i.e. if PTANK≦P1, the charging flag FCHARGE) the purging flag FPURGE, and a checking flag FCHECK are all set to 0, at a step S17, and then the charging timer is set to the predetermined time period tc and started, at a step S18, and a purging timer which counts a time period elapsed after purging is started, is set to a predetermined time period tp and started, at a step S28, followed by terminating the present program. The checking flag FCHECK is set to 1 when it is supposed that there is a failure in the charging line.

If the answer to the step S16 is affirmative (YES) (i.e., if PTANK>P1 which indicates that evaporative fuel is generated in the fuel tank at a time point t1 in FIG. 8), the charging flag FCHARGE is set to 1 to carry out forced charging (step S19). At the same time, the temperature difference ΔT1 (=Ta−Tb) during charging is calculated, at a step S20, and then it is determined at a step S21 whether or not the difference (ΔT1−ΔT0) between the calculated temperature difference ΔT1 and the above calculated initial value ΔT0 is greater than a predetermined value C. If ΔT1−ΔT0≦C. it is determined at a step S23 whether or not the count in the charging timer is equal to 0 (i.e., whether or not the predetermined time period tc has elapsed after the start of charging). If the predetermined time period tc has not elapsed, the program proceeds to the step S28, whereas if the predetermined time period tc has elapsed, the checking flag FCHECK is set to 1 at a step S24, and then the program proceeds to a step S25 in FIG. 7. That is, if the charging line is normally functioning, the temperature difference (ΔT1−ΔT0) should reach the predetermined value C before the predetermined time period tc elapses (e.g., at a time point t2) after the start of charging. Therefore, if the temperature difference (ΔT1−ΔT0) does not reach the predetermined value C even after the predetermined time period tc has elapsed, it is judged that there is a high probability of a failure in the charging line.

If the answer to the question of the step S21 is affirmative (YES) (i.e., if (ΔT1−ΔT0)>C holds), the purging timer is set to the predetermined time period tp and started, at a step S22, and then the program proceeds to the step S25.

At the step S25, the purging flag FPURGE is set to 1, and the charging flag FCHARGE is set to 0, at a step S26.

Accordingly, the forced charging is interrupted, and the purge cut valve 28 is opened to enable purging. At the next step S27, it is determined whether or not the engine 1 and the vehicle are in a predetermined condition enabling purging. Specifically, this determination is made based upon throttle valve opening θTH, engine rotational speed NE, intake pipe absolute pressure PBA, and vehicle speed V. That is, when such high vacuum is produced in the intake pipe 2 at a location at which the open end of the conduit 30 opens into the intake pipe 2 (i.e., in the vicinity of the throttle valve 3), as causes purging fuel to be drawn into the intake pipe 2. If the answer to the step S27 is negative (NO) (i.e., if the predetermined purging-enabling condition is not satisfied), no adsorbed fuel is actually purged even if the purge cut valve 28 is open. Therefore, the program proceeds to the step S28 without effecting abnormality detection at steps S29 et seq.

If the answer to the step S27 is affirmative (YES) (i.e., if the predetermined purging-enabling condition is satisfied), the temperature difference ΔT2 (=Ta−Tb) during purging is calculated at the step S29. It is determined at step S30 whether or not this temperature difference ΔT2 (=Ta−Tb) is smaller than the initial value ΔT0. If the answer to this step is affirmative (YES) (i.e., if ΔT2<ΔT0 holds (at a time point t3 in FIG. 3), it is judged that the evaporative fuel control system is normally functioning (at a step S31), and then the purging flag FPURGE and the checking flag FCHECK are both set to 0, at a step S32, followed by terminating the present program.

If the answer to the step S30 is negative (NO) (i.e., if $\Delta T2 \geqq \Delta T0$ holds), it is determined at a step S33 whether or not the predetermined time period tp has elapsed after the predetermined purging-enabling condition became satisfied. If the answer to this step is negative (NO), such as if the predetermined time period tp has not elapsed, the program is immediately terminated. If the answer to this step is affirmative (YES), such as if the predetermined time period tp has elapsed, it is judged that there is a high probability of a failure in the purging line, and then it is determined at a step S34 whether or not the checking flag FCHECK is equal to 1. If FCHECK=0, the program proceeds to the step S32, whereas if FCHECK=1, it is judged that there is a failure in the evaporative fuel control system, at a step S35, followed by terminating the program.

In the above described manner, according to the program of FIGS. 6 and 7, only when there is a high probability of failures in both the charging line and the purging line, it is finally judged that the evaporative fuel control system is abnormal. Thus, the abnormality detection provides accurate detection results.

According to the first embodiment described above, during charging and/or during purging the temperature of the adsorbent or in the vicinity thereof at a plurality of locations within the evaporative fuel storage device, abnormality detection accuracy higher than the conventional system which detects the temperature at a single point can be achieved. Particularly, even when evaporative fuel is present in small quantities and the charged amount is insufficient, accurate abnormality detection can be performed.

FIGS. 9-12 show programs for carrying out abnormality detection according to a second embodiment of the invention, and more specifically a manner of determining the timing of starting abnormality detection by the use of the aforedescribed manner of detecting a charged state of the canister, and effecting the abnormality detection after the determined starting timing.

Figure 9:
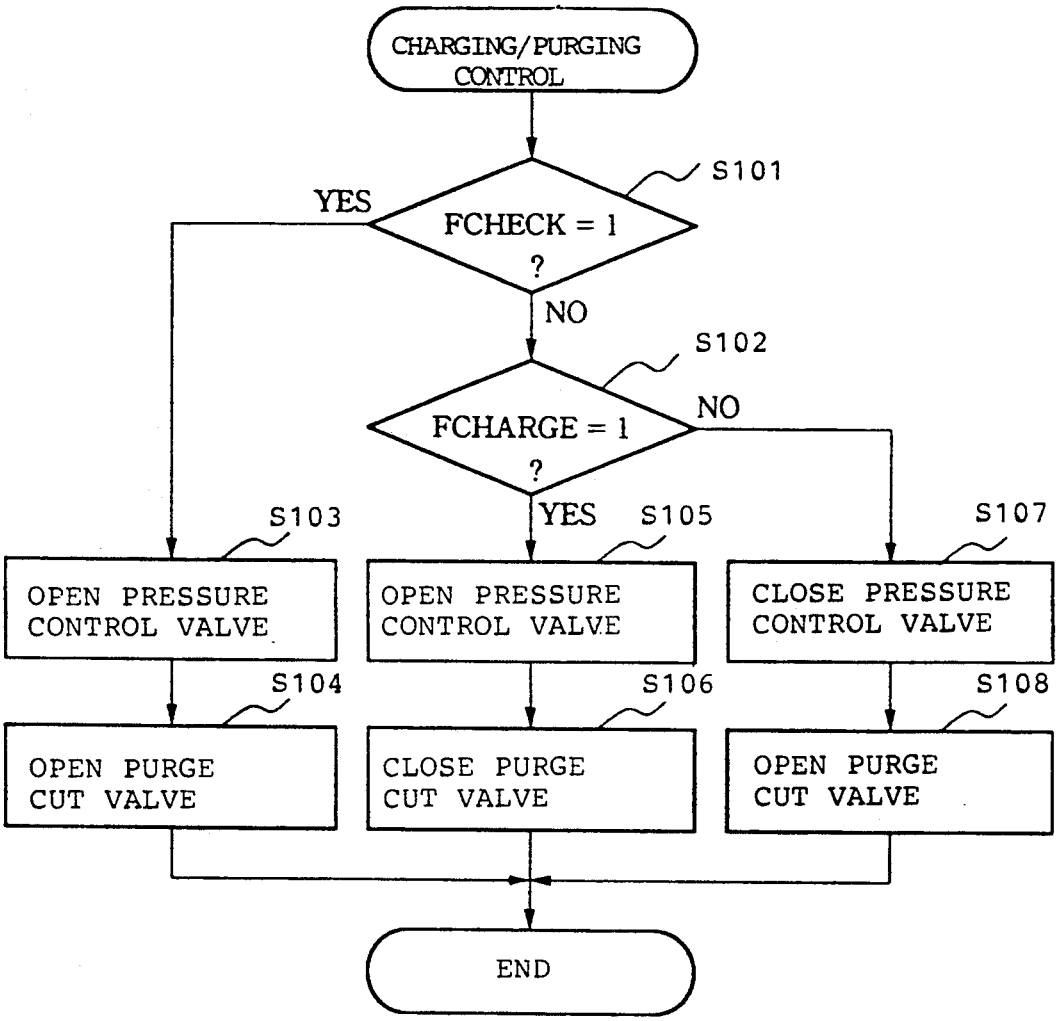
FIG. 9 is a flowchart showing a program for controlling the pressure control valve and the purge cut valve according to a second embodiment of the invention.

The program of FIG. 9 controls the pressure control valve 26 and the purge cut valve 28 in the following manner in response to the values of a charging flag FCHARGE and a checking flag FCHECK which are set by the programs of FIGS. 10-12, hereinafter referred to:

1) If FCHECK=0, and FCHARGE=1 (if the answer to a step S101 is negative or NO, and at the same time the answer to a step S102 is affirmative or YES), the pressure control valve 26 is opened, and the purge cut valve 28 is closed (steps S105, S106), whereby forced charging is effected.
2) If FCHECK=0, and FCHARGE=0 (if the answers to the steps S101 and S102 are both negative or NO), the pressure control valve 26 is closed, and the purge cut valve 28 is opened (steps S104 and S105), whereby forced charging is interrupted to enable purging.
3) If FCHECK=1 (if the answer to the step S101 is affirmative or YES), the pressure control valve 26 and the purge cut valve 28 are both opened.

Figure 10:
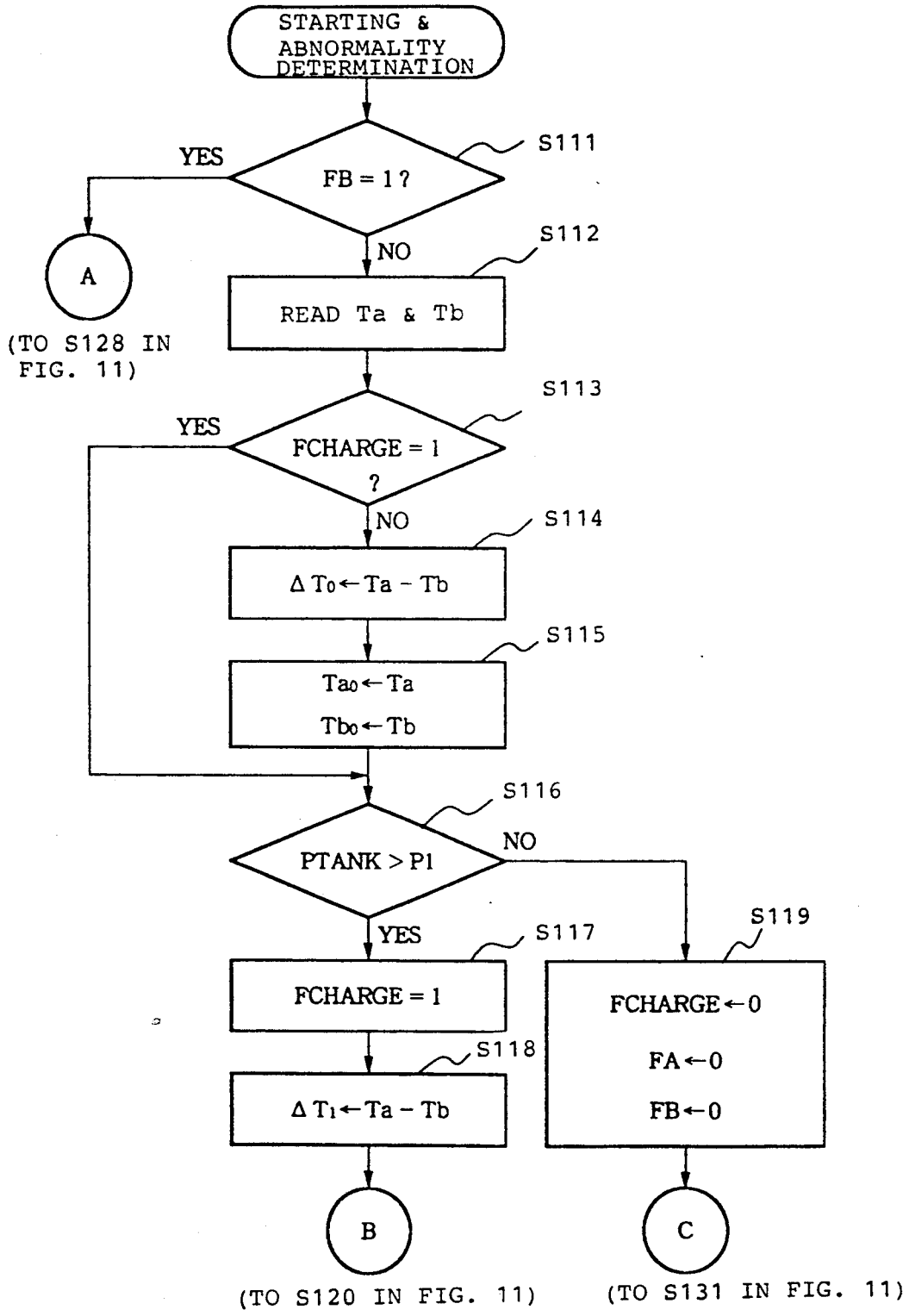
FIG. 10 is a flowchart showing a program for determining conditions for and timing of starting abnormality detection according to the second embodiment.
Figure 11:
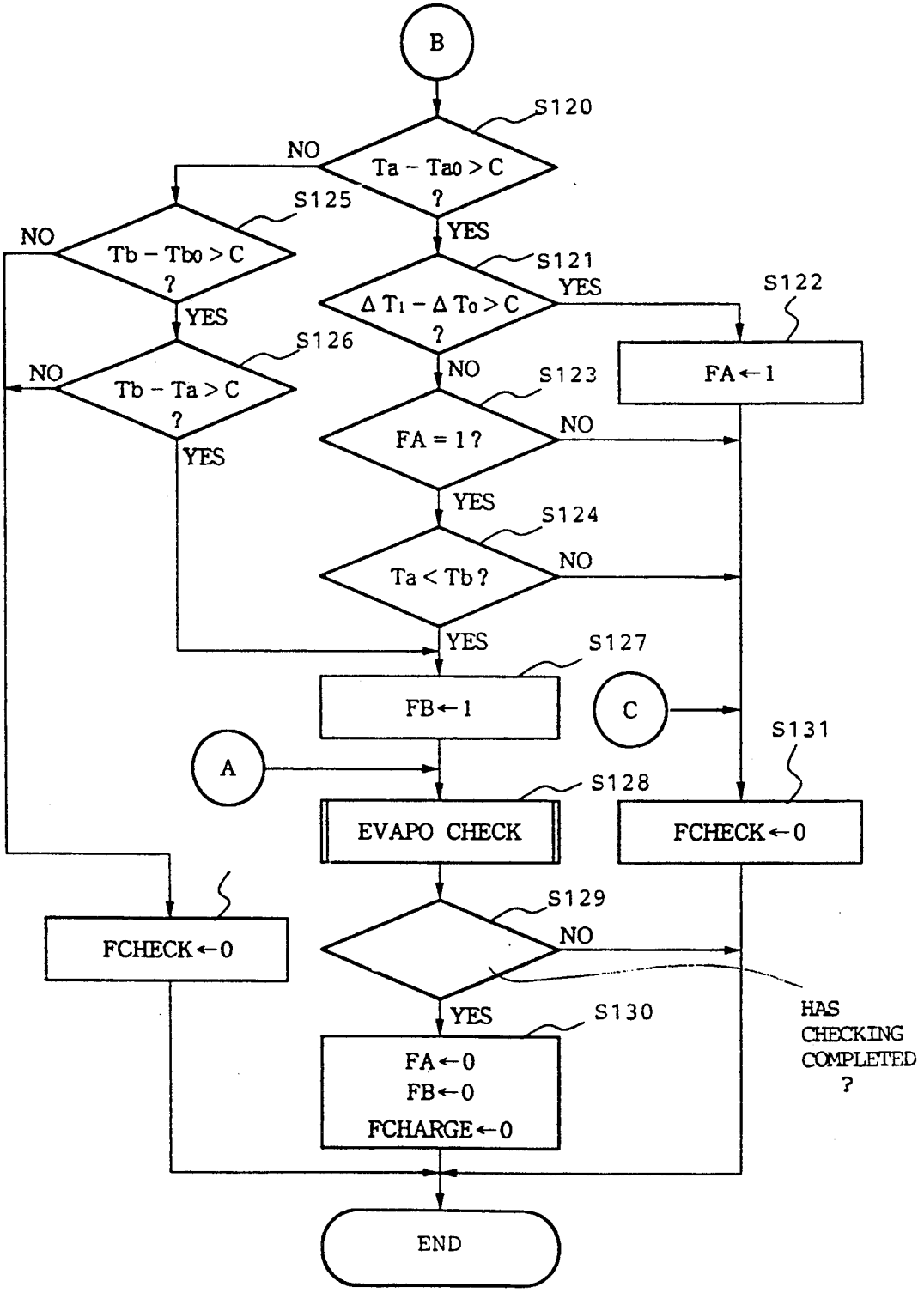
FIG. 11 is a similar view continued from FIG. 10.
Figure 12:
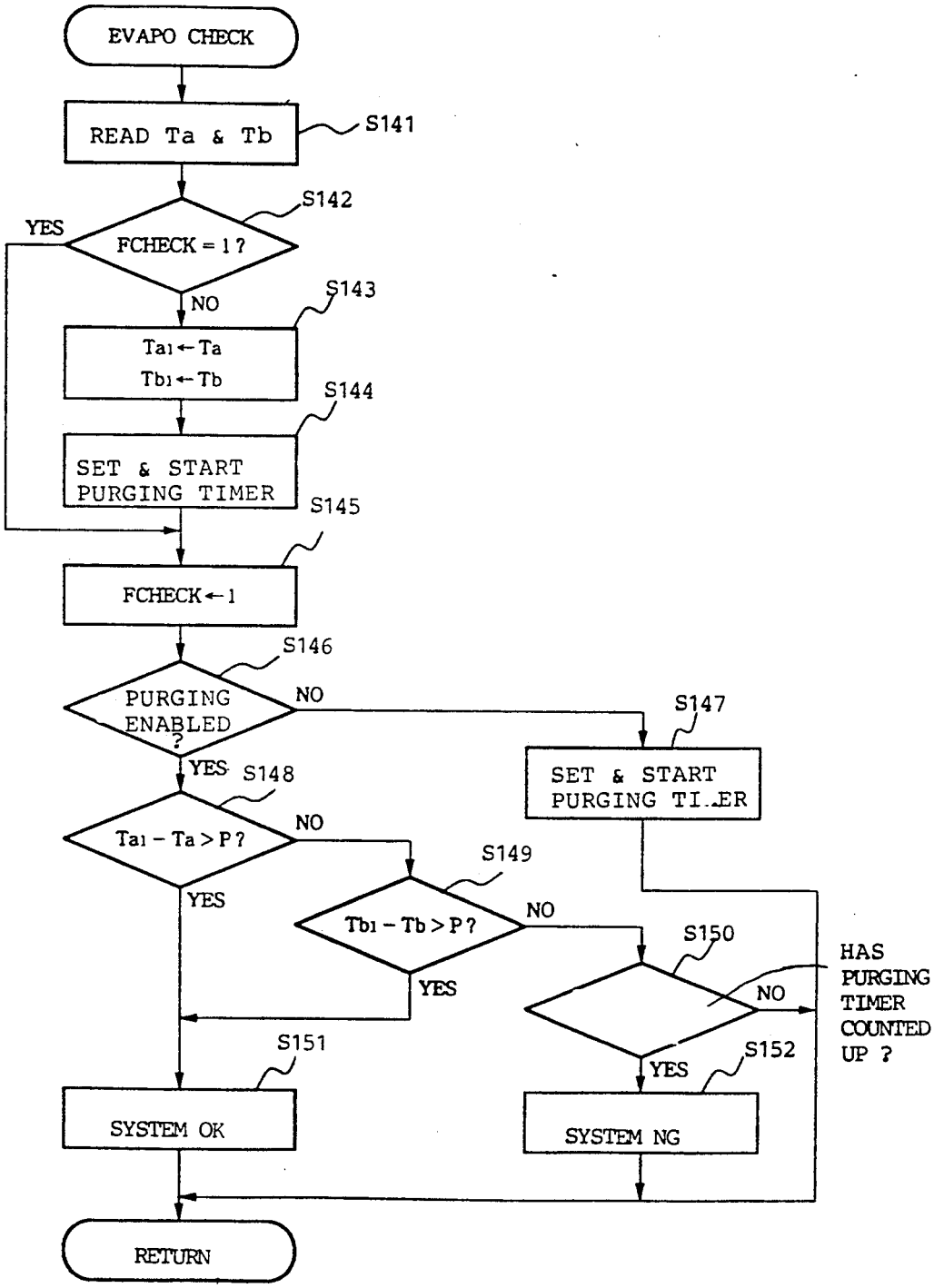
FIG. 12 is a flowchart showing a program for carrying out abnormality detection according to the second embodiment.
Figures 13A, 13B, 13C:
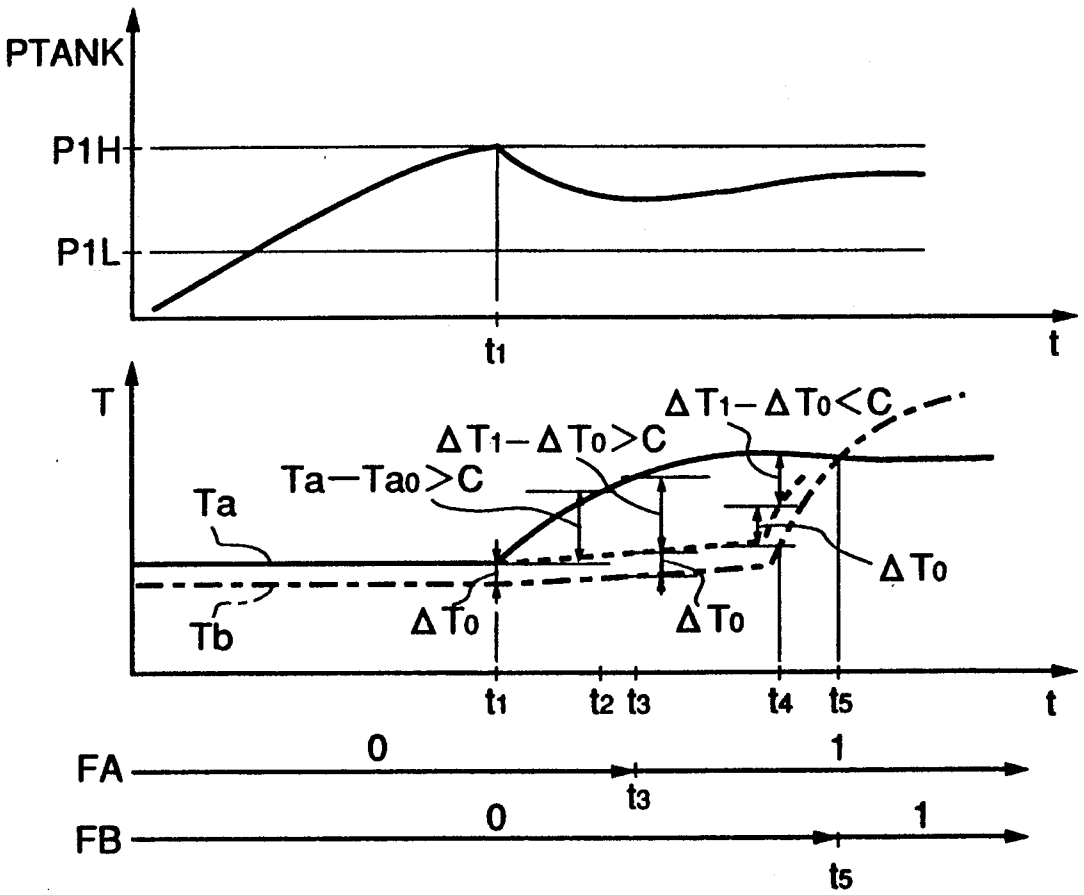
FIGS. 13(*a*), (*b*) and (*c*) are timing charts showing changes in the fuel tank pressure PTANK, the canister temperature T, and flags FA and FB with the lapse of time.
Figures 14A, 14B:
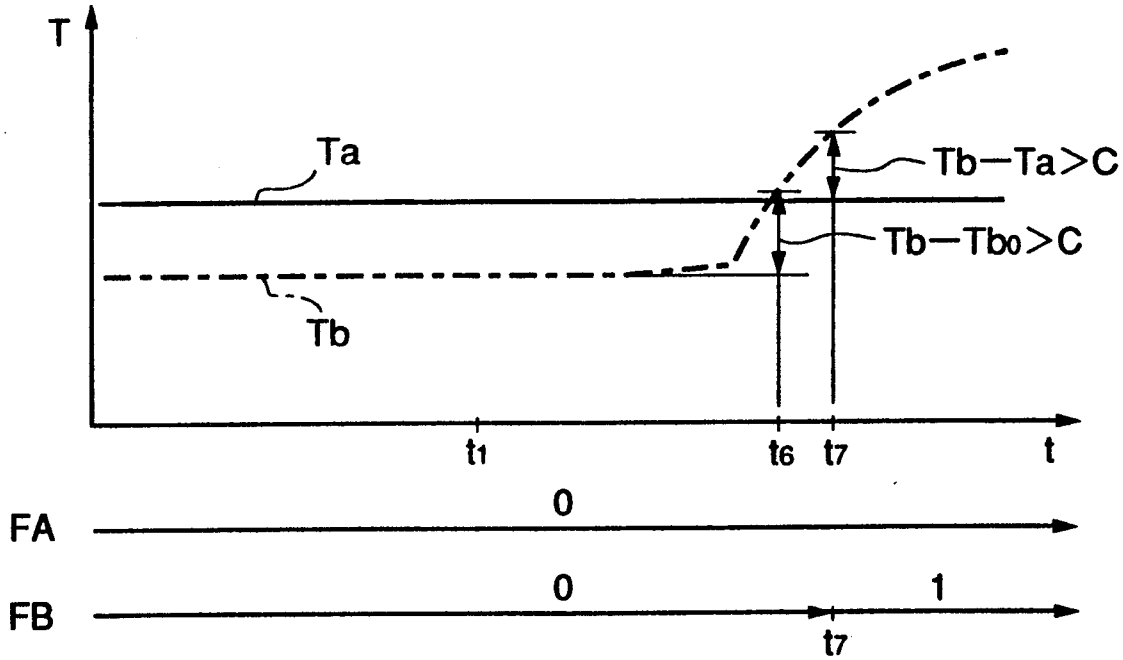
FIG. 14 is a graph showing changes in the canister temperature T and the flags FA, FB with the lapse of time.
Figure 15:
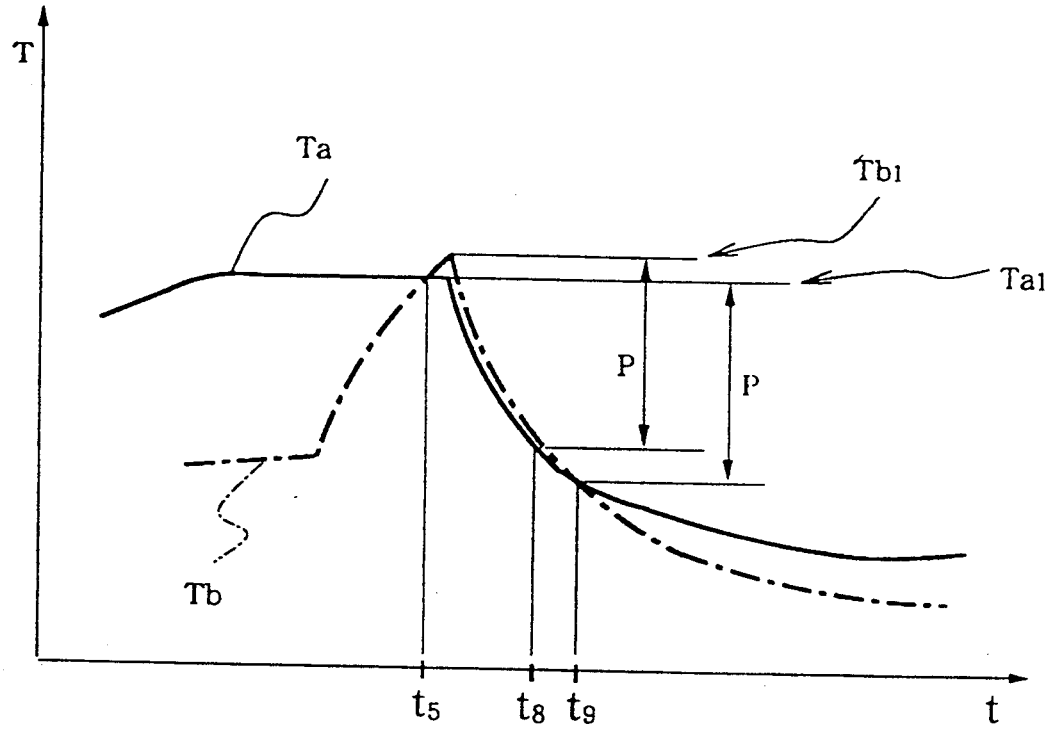
FIG. 15 is a graph showing changes in the canister temperature T with the lapse of time.

The programs of FIGS. 10-12 carry out determination of the timing of starting abnormality detection and the abnormality detection after the determined starting timing. FIGS. 13-15 show transitions in the pressure PTANK detected by the tank internal pressure sensor 22, temperature values Ta, Tb detected by the first and second temperature sensors 31, 32, and setting of flags FA and FB which are set by the programs of FIGS. 10 and 11. The programs of FIGS. 10 and 11 are executed in synchronism with the generation of the TDC signal or at constant time intervals.

At a step S111 in FIG. 10, it is determined whether or not a flag FB is equal to 1. The flag FB is set to 1 when a predetermined condition for starting abnormality detection is satisfied. If the answer is affirmative (YES), the program jumps to a step S128 in FIG. 11. If the answer to the step S111 is negative (NO) (i.e., if FB=0), the detected temperature values Ta, Tb from the first and second temperature sensors 31, 32 are read into the CPU 5*b*, at a step S112, and it is determined at a step S113 whether or not the charging flag FCHARGE which is set to 1 when forced charging is to be effected is equal to 1. If the answer is affirmative (YES), the program jumps to a step S116, whereas if the answer is negative (NO), a calculation is made of an initial value $\Delta TO$ (=Ta−Tb) of the difference between the detected temperature values Ta, Tb from the first and second temperature sensors 31, 32, at a step S114. The detected temperature values Ta, Tb are stored as respective initial values Ta0, Tb0, at a step S115. At the next step S116, it is determined whether or not the pressure PTANK within the fuel tank is higher than the predetermined value P1. The predetermined value P1 is provided with a hysteresis as mentioned hereinbefore.

If the answer to the step S116 is negative (NO), (i.e., if PTANK≦P1), the charging flag FCHARGE and flags FA, FB are all set to 0, at a step S119, and then the program proceeds to a step S131 in FIG. 11 to set the checking flag FCHECK to 0, followed by terminating the present program. The flag FA is set to 1 when the difference ($\Delta T1-\Delta T0$) between the detected temperature difference $\Delta T1$ during forced charging and the initial values $\Delta T0$ exceeds a predetermined value C, at steps S121, S122, hereinafter referred to. The checking flag FCHECK is set to 1 when the abnormality detection is to be effected, at a step S130, hereinafter referred to.

If the answer to the step S116 is affirmative (YES), i.e. if PTANK>P1 which indicates that evaporative fuel is generated in the fuel tank (at a time point t1 in FIG. 13), the charging flag FCHARGE is set to 1 to carry out forced charging (step S117). At the same time, the temperature difference $\Delta T1$ (=Ta−Tb) during charging is calculated, at a step S118, and then it is determined at a step S120 whether or not the difference (Ta−Ta0) between a present value Ta of the detected temperature from the first temperature sensor 31 (the temperature at the point A in the canister) and its initial value Ta0 is greater than the predetermined value C. If Ta−Ta0>C (at a time point t2 at (b) in FIG. 13), it is determined at a step S121 whether or not the difference ($\Delta T1-\Delta T0$) between the detected temperature difference $\Delta T1$ and its initial value $\Delta T0$ is greater than the predetermined value C. If $\Delta T1-\Delta T0 \leqq C$, it is determined at a step S123 whether or not the flag FA is equal to 1. If FA=0 (between t2 and t3 at (b) in FIG. 13 (b)), the program is immediately terminated.

If $\Delta T1-\Delta T0<C$ afterwards (at t3 at (b) and (c) in FIG. 13), the flag FA is set to 1 at a step S122, followed by terminating the program. If again $\Delta T1-\Delta T0 \leqq C$ afterwards (at t4 at (b), (c) in FIG. 13), the program proceeds to the step S123 which in turn provides an affirmative answer (YES). Accordingly, it is determined at a step S124 whether or not the temperature Ta at the point A is equal to or higher than the temperature Tb at the point B. If Ta≧Tb, the program is immediately terminated, whereas if Ta<Tb (at t5 at (b), (c) in FIG. 13), it is ascertained that the canister has been charged to the point B or into the vicinity thereof. Accordingly, it is judged that the predetermined condition for starting abnormality detection has been satisfied, and hence the flag FB is set to 1 at a step S127 to carry out the abnormality detection program (EVAPO CHECK) of FIG. 12, at a step S128.

On the other hand, if the answer to the step S120 is negative (NO) (i.e., if Ta−Ta0≦C), it is determined at a step S125 whether or not the difference (Tb−Tb0) between a present value Tb of the temperature at the point B and its initial value Tb0 is greater than the predetermined value C. That is, when the state of Ta−Ta0≦C has continued, it is judged that charging has already proceeded to the point A (see FIG. 14), and accordingly the temperature variation at the point B is now to be checked.

If the answer to the step S125 is negative (NO) (i.e., if Tb−Tb0≦C), the checking flag FCHECK is set to 0, at a step S132, followed by terminating the program. If the answer is affirmative (YES) (i.e., if Tb−Tb0>C at t6 in FIG. 14), it is determined at a step S126 whether or not the difference (Tb−Ta) between the temperature at the point B and the temperature Ta at the point A is greater than the predetermined value C. If Tb−Ta≦C (between t6 and t7 in FIG. 14), the program is immediately terminated, whereas if Tb−Ta>C (at t7 in FIG. 14), it is ascertained that charging has proceeded to the point B. Accordingly, it is judged that the predetermined condition for starting abnormality detection has been satisfied, and then the program proceeds to the step S127.

After execution of the step S128, it is determined at a step S129 whether or not the abnormality detection has been completed. If the answer is negative (NO), the present program is immediately terminated, whereas if the answer is affirmative (YES), the flags FA, FB and FCHARGE are all set to 0, at a step S130, followed by terminating the program.

Next, the abnormality detection program of FIG. 12 will be explained.

At a step S141 in FIG. 12, temperature values Ta, Tb at the points A, B are read into the CPU 5*b*, and then it is determined at a step S142 whether or not the flag FCHECK is equal to 1. If the answer is affirmative (YES), the program jumps to a step S145. If the answer is negative (NO), present values of the temperature values Ta, Tb are stored as respective values Ta1, T1 assumed immediately before starting of purging (see FIG. 15), at a step S143, and then the purging timer which counts a time period elapsed after the start of purging is set to the predetermined time period tp and started, at a step S144. Then, the flag FCHECK is set to 1, at a step S145.

Accordingly, the forced charging is interrupted, and the purge cut valve 28 is opened to enable purging. At the next step S145, it is determined whether or not the engine 1 and the vehicle are in a predetermined condition enabling purging. Specifically, this determination is made in a similar manner to that of the first embodiment described before, (e.g. it is made based upon throttle valve opening θTH, engine rotational speed NE, intake pipe absolute pressure PBA, and vehicle speed V). That is, when such a high vacuum is produced in the intake pipe 2 at a location at which the open end of the circuit 30 opens into the intake pipe 2 (i.e., in the vicinity of the throttle valve 3), this causes purging fuel to be drawn into the intake pipe 2. If the answer to the step S146 is negative (NO), (i.e. , if the predetermined purging-enabling condition is not satisfied), no adsorbed fuel is actually purged even if the purge cut valve 28 is open. Therefore, the purging timer is set to the predetermined time period tp without effecting abnormality detection at steps S148 et seq (Then, the step S129 in FIG. 11 is executed).

If the answer to the step S146 is affirmative (YES), ( i.e., if the predetermined purging-enabling condition is satisfied), it is determined at a step S148 whether or not the difference (Ta1−Ta) between a value Ta1 of the temperature at the point A assumed immediately before the start of purging and a present value Ta thereof is greater than a predetermined value P. If Ta1−Ta≦P, it is determined at a step S147 whether or not the difference (Tb1−Tb) between a value Tb1 of the temperature at the point B assumed immediately before the start of purging and a present value Tb thereof is greater than the predetermined value P. If the answer to either the step S148 or S149 is affirmative (YES), (i.e., if Ta1−Ta>P or Tb1−Tb>P, see t8, t9 in FIG. 15), it is judged that there is no failure in the evaporative fuel control system, at a step S151, followed by terminating the program.

If the answers to both the steps S148 and S149 are negative (NO), (i.e., if Ta1−Ta≦P and at the same time Tb1−Tb≦P), it is determined at a step S150 whether or not the count in the purging timer is equal to 0 (i.e., whether or not the predetermined time period tp has elapsed after fulfillment of the predetermined purging-enabling condition). If the answer is negative (NO), the program is immediately terminated. If the answer is affirmative (YES) (i.e., if the state in which Ta1−Ta≦P and at the same time Tb1−Tb≦P, has continued over the predetermined time period tp), it is judged at a step S152 that there is a failure in the evaporative fuel control system, followed by terminating the program.

This control system is based upon the recognition that if the evaporative fuel control system is normally functioning, the amount of a drop in the temperature at the point A or B exceeds the predetermined value P before the lapse of the predetermined time period tp. Therefore, according to the present embodiment, when the temperature drop amount is insufficient (below the predetermined value P), it is judged that the control system is faulty.

According to the program of FIGS. 10 and 11 described above, it is possible to accurately determine whether or not charging has proceeded to the point B (exactly, the area encompassing the point B). Based upon this accurate determination, the abnormality detection of FIG. 12 is started after charging has proceeded to the point B, to thereby avoid a misjudgement which would be made if abnormality detection is started when the charged amount in the canister is insufficient as in the prior art hereinbefore referred to. Further, by appropriately setting the predetermined value P and the predetermined time period tp used in the program of FIG. 12, accurate abnormality detection can be made within a short time period.

Further, according to the present embodiment, the temperature of the absorbent or in its vicinity is detected by a plurality of temperature sensors, and after completion of fuel adsorption is detected based upon amounts of a rise in the temperature values from the sensors, abnormality detection is made based upon the amounts of the drop thereof. Therefore, the accuracy of abnormality detection can be further improved. That is, if the canister temperature is detected at a single point, it can happen that the detected temperature does not show any change depending upon the initial state of the canister (see FIG. 3(c)). Consequently, it can be erroneously judged that no adsorption or charging is being effected. However, this can be overcome by employing a plurality of temperatures as described above.

Figure 16:
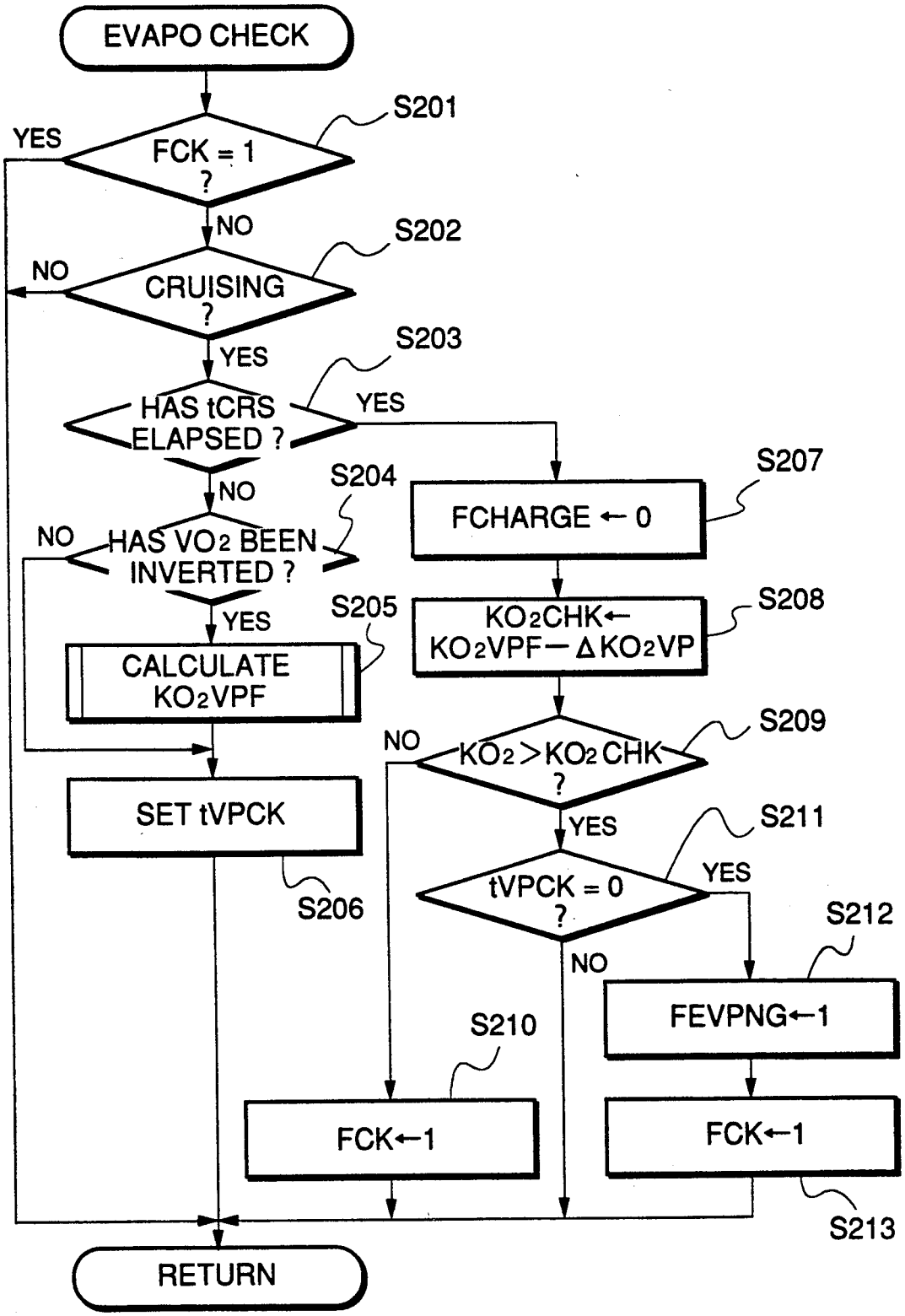
FIG. 16 is a flowchart showing a program for detecting abnormality according to a third embodiment of the invention.
Figure 17:
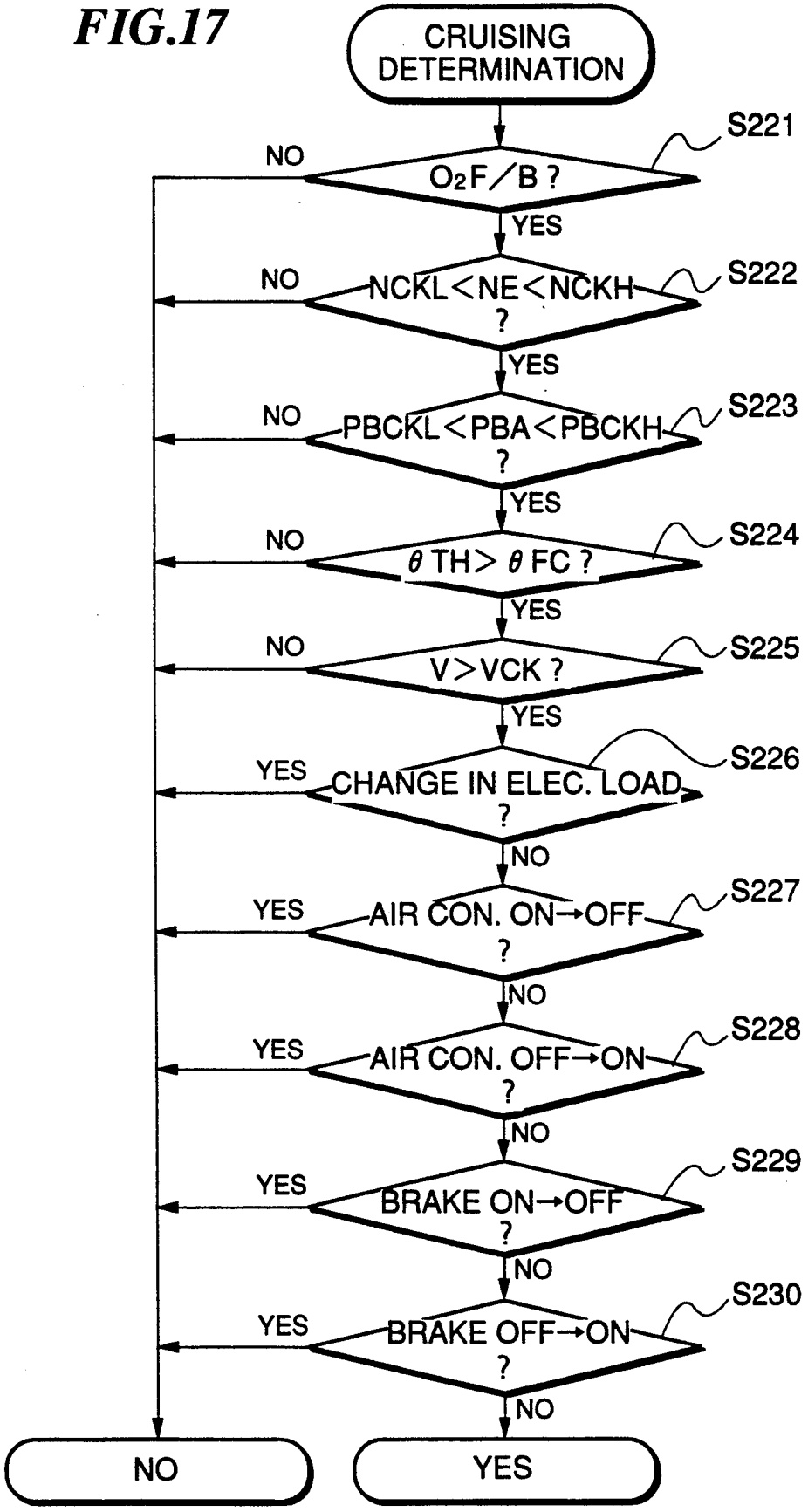
FIG. 17 is a flowchart showing a program for determining whether the vehicle is cruising.

FIGS. 16 and 17 show programs for carrying out abnormality detection according to a third embodiment of the invention. Charging/purging control and determination of the condition for starting abnormality detection described above with reference to FIGS. 9-11 can also be applied to the present embodiment, except that the steps S101, S103, and S104 in FIG. 9 and the steps S131 and S132 in FIG. 11 are omitted in the present embodiment.

At a step S201 in FIG. 16, it is determined whether or not a flag FCK is equal to 1, the flag FCK being set to 0 at the starting of the engine, and to 1 upon completion of the abnormality detection. If the answer is affirmative (YES), the present program is immediately terminated, and then the step S129 in FIG. 11 is executed. If the answer to the step S201 is negative (NO) (i.e., if FCK=0), it is determined at a step S202 whether or not the vehicle is in a cruising condition.

This determination is executed by the program of FIG. 17.

In the program of FIG. 17, the following determinations are made: whether or not air-fuel ratio feedback (F/B) control responsive to output from the $O_2$ sensor 11 is now being carried out (step S221); whether or not the engine rotational speed NE calculated from TDC signal pulses from the engine rotational speed sensor 8 lies within a range defined by a predetermined lower limit NCKL (e.g. 2000 rpm) and a predetermined upper limit NCKH (e.g. 4000 rpm) (step S222); whether or not the intake pipe absolute pressure PBA sensed by the intake pipe absolute pressure sensor 7 lies within a range defined by a predetermined lower limit PBCKL (e.g. 310 mmHg) and a predetermined upper limit PBCKH (e.g. 610 mmHg) (step S223); whether or not the throttle valve opening θTH sensed by the throttle valve opening sensor 4 is greater than a predetermined value θFC corresponding to a substantially fully closed position of the throttle valve 3 (step S224); whether or not the vehicle speed V sensed by the vehicle speed sensor 12 is higher than a predetermined value VCK (e.g. 8 km/h) (step S225); whether or not there has been a change in the electrical load, which is sensed by the electrical load sensor 13, between the immediately preceding loop and the present loop (step S226); whether or not the air conditioner has been changed from an ON state to an OFF state or vice versa, which is detected from output from the air conditioner switch sensor 14, between the immediately preceding loop and the present loop (steps S227 and S228); and whether or not the brake has been changed from an ON state to an OFF state or vice versa (steps S229 and S230).

If the answer to any of the steps S221 to S225 is negative (NO) or if the answer to any of the steps S226 to S230 is affirmative (NO), it is determined that the vehicle is not cruising (the answer to the step S202 in FIG. 16 is negative or NO). On the other hand, if all the answers to the steps S221 to S225 are affirmative (YES), and at the same time if all the answers to the steps S226 to S230 are negative (NO), it is determined that the vehicle is cruising (the answer to the step S202 in FIG. 16 is affirmative or YES).

Referring again to FIG. 16, if the answer to the step S202 is negative (NO) (i.e., if the vehicle is not cruising), the present program is immediately terminated. If the answer is affirmative (YES) (i.e., if the vehicle is cruising), it is determined at a step S203 whether or not the vehicle has been continuously cruising over a predetermined time period tCRS (e.g. 5 seconds). If the answer is negative (NO), the output VO2 from the $O_2$ sensor 11 is compared with a predetermined value. From the result of that comparison, it is determined at a step S204 whether or not the sensor output has been inverted between the immediately preceding loop and the present loop.

If the answer to the step S204 is affirmative (YES), an average value KO2VPF of the air-fuel ratio feedback correction coefficient KO2 is calculated by the use of the following equation (2):

$$KO2VPF = KO2 \times CO2VPF/256 + KO2VPF \times (256 - CO2VPF)/256 \quad (2)$$

where KO2 represents a present value of the correction coefficient KO2 calculated from the output from the $O_2$ sensor 11 by another routine executed whenever a TDC signal pulse is generated, and CO2VPF a predetermined value selected to one of values 1-256, KO2VPF on the right side a value of the average value KO2VPF obtained in the immediately preceding loop, the initial value of which is set to 1.0.

On the other hand, if the answer to the step S204 is negative (NO), the program skips over the step S205 to a step S206. At the step S206, a tVPCK timer, which counts a time period elapsed after the start of purging, is set to a predetermined time period tVPCK (e.g. 5 seconds) and started, followed by terminating the program.

If the answer to the step S203 is affirmative (YES), (i.e., if the predetermined time period tCRS has elapsed after the vehicle started cruising), it is judged that purging is to be immediately effected, and the flag FCHARGE is set to 0 at a step S207. Then, a correction value ΔKO2VP (e.g. equal to 20% of the average value KO2VPF) corresponding to the purging amount is subtracted from the average value KO2VPF calculated at the step S205, to obtain a discrimination value KO2CHK, at a step S208. It is then determined at a step S209 whether or not the present value of the correction coefficient KO2 is greater than the discrimination value KO2CHK thus obtained.

If the answer to the step S209 is negative (NO) (i.e., if the present value of the correction coefficient KO2 is equal to or smaller than the discrimination value KO2CHK), it is judged that there is no abnormality that would cause a reduction in the purging amount, at a location intermediate between the canister 27 and the intake pipe 2 (i.e., a fault which impedes a decrease in the value of the air-fuel ratio correction coefficient KO2 which exceeds the value ΔKO2VP), and then the flag FCK is set to 1 to indicate completion of the abnormality detection, at a step S210, followed by terminating the program.

On the other hand, if the answer to the step S209 is affirmative (YES), it is determined at a step S211 whether the count in the tVPCK timer is equal to 0. If the answer is negative (NO), the program is immediately terminated without setting the flag FCK to 1. If the value of the correction coefficient KO2 has continuously been greater than the discrimination value KO2CHK over the predetermined time period tVPCK (the answers to the steps S209 and S211 are affirmative), it is judged that there is an abnormality in the evaporative fuel control system, and then a flag FEVPNG is set to 1, at a step S212, and the flag FCK is set to 1, at a step S213, followed by terminating the program. When the flag FEVPNG has thus been set to 1 to indicate that there is an abnormality in the evaporative fuel control system, a predetermined failsafe function is performed, such as warning the vehicle driver of the abnormality.

By thus starting abnormality detection by the programs of FIGS. 16 and 17, after charging has proceeded as far as the point B of the canister 27, depending upon the result of the determination of the program of FIGS. 10 and 11, a misjudgement can be avoided which would be made if the abnormality detection were started when the canister 27 had not yet been charged to a sufficient degree.

As described above, according to the third embodiment, an abnormality detection based upon the air-fuel ratio correction coefficient is started when the amount of the rise in the temperature of the adsorbent or in its vicinity within the evaporative fuel storage device is greater than a predetermined value. In other words, determining when the evaporative fuel has been charged to a sufficient degree within the evaporative fuel storage device improves the accuracy of abnormality detection.

Further, according to the present embodiment, the determination as to whether the amount of the rise in the temperature is greater than the predetermined value is effected while charging is being effected in a state in which evaporative fuel is generated within the fuel tank, whereby the degree of charging into the evaporative fuel storage device can be more accurately grasped.

Still further, the timing of starting the abnormality detection is determined based upon temperature values detected by a plurality of temperature sensors, the amounts of the rise in the respective temperature values, and the difference between the detected temperature values, thereby enabling one to determine the starting timing to a proper timing, irrespective of the charged state (initial state) within the evaporate fuel storage device immediately before charging. More specifically, in the case where the temperature is detected at a single point, the detected temperature cannot always show a change, depending upon the initial state within the evaporative fuel storage device (FIG. 3(*c*)), thus resulting in a misjudgement that no charging is being carried out. On the other hand, this disadvantage can be overcome by using a plurality of temperature sensors as in the present invention.

What is claimed is:

1. In an abnormality detection system for detecting abnormality in an evaporative fuel control system for an internal combustion engine having a fuel tank, and an intake system, said evaporative fuel control system having an evaporative fuel storage device accommodating an absorbent for adsorbing evaporative fuel generated in said fuel tank, the improvement comprising:

a plurality of temperature sensors arranged in said evaporative fuel storage device at different locations for detecting temperature of said adsorbent or in the vicinity thereof within said evaporative fuel storage device at said different locations;

evaporative fuel control means for controlling at least one of charging of said evaporative fuel from said fuel tank to said evaporative fuel storage device and purging of said evaporative fuel from said evaporative fuel storage device to said intake system of said engine; and abnormality determining means for determining whether or not there is an abnormality in said evaporative fuel control system, based upon output values from said temperature sensors assumed when said evaporative fuel control system is operative.

2. An abnormality detection system as claimed in claim 1, including charging control means for effecting said charging when said evaporative fuel is generated in said fuel tank, and wherein said abnormality determining means effects said abnormality determination, based upon said output values from said temperature sensors assumed when said charging is being effected.

3. An abnormality detection system as claimed in claim 1, including purging detecting means for detecting whether or not said purging is being effected, and wherein said abnormality determining means effects said abnormality determination, based upon said output values from said temperature sensors assumed when said purging is being effected.

4. An abnormality detection system as claimed in claim 2, wherein said evaporative fuel storage device has a first opening arranged on a side of said device and communicating with said fuel tank, and a second opening arranged on another side of said device opposite to said first opening and communicating with the atmosphere, said temperature sensors comprising a first temperature sensor for detecting a temperature at a location close to said first opening, and a second temperature sensor for detecting a temperature at a location close to said second opening, said abnormality determining means judging that there is a possibility of an abnormality in said evaporative fuel control system when a difference between a difference between temperature values detected by said first and second temperature sensors when said charging is being effected, and a difference between temperature values detected by said first and second temperature sensors immediately before said charging is started has continuously been smaller than a predetermined value over a predetermined time period after said charging was started.

5. An abnormality detection system as claimed in claim 2 or 3, wherein said evaporative fuel storage device has a first opening arranged on a side of said device and communicating with said fuel tank, and a second opening arranged on another side of said device opposite to said first opening and communicating with the atmosphere, said temperature sensors comprising a first temperature sensor for detecting a temperature at a location close to said first opening, and a second temperature sensor for detecting a temperature at a location close to said second opening, said abnormality determining means judging that there is a possibility of an abnormality in said evaporative fuel control system when a difference between a difference between temperature values detected by said first and second temperature sensors when said purging is being effected, and a difference between temperature values detected by said first and second temperature sensors immediately before said purging is started has continuously been smaller than a predetermined value over a predetermined time period after said purging was started.

6. In an abnormality detection system for detecting abnormality in an evaporative fuel control system for an internal combustion engine having a fuel tank, and an intake system, said evaporative fuel control system having an evaporative fuel storage device accommodating an adsorbent for adsorbing evaporative fuel generated in said fuel tank, purging control means for purging said evaporative fuel from said evaporative fuel storage device to said intake system, temperature detecting means for detecting temperature of said adsorbent or in the vicinity thereof within said evaporative fuel storage device, said abnormality detection system including abnormality determining means for effecting determination of abnormality in said evaporative fuel control system, based upon an amount of drop in said temperature detected by said temperature detecting means when said purging is being effected by said purging control means, the improvement comprising:

adsorption completion-detecting means for detecting a state in which adsorption of said evaporative fuel generated in said fuel tank to said adsorbent of said evaporative fuel storage device has been completed, based upon an amount of rise in said temperature detected by said temperature detecting means while said charging is being effected; and wherein said abnormality determining means effects said abnormality determination after said state has been detected by said adsorption completion-detecting means.

7. An abnormality detection system as claimed in claim 6, wherein said temperature detecting means comprises a plurality of temperature sensors arranged at different locations within said evaporative fuel storage device for detecting said temperature of said adsorbent or in the vicinity thereof at said different locations, said adsorption completion-detecting means detecting completion of said adsorption of said evaporative fuel, based upon amounts of rise in temperatures detected respectively by said temperature sensors while said charging is being effected.

8. An abnormality detection system as claimed in claim 6, wherein said temperature detecting means comprises a plurality of temperature sensors arranged at different locations within said evaporative fuel storage device for detecting said temperature of said adsorbent or in the vicinity thereof at said different locations, said abnormality determining means effecting said abnormality determination, based upon amounts of drops in temperature detected respectively by said temperature sensors while said purging is being effected.

9. An abnormality detection system as claimed in claim 7, wherein said evaporative fuel storage device has a first opening arranged on a side of said device and communicating with said fuel tank, and a second opening arranged on another side of said device opposite to said first opening and communicating with the atmosphere, said temperature sensors comprising a first temperature sensor for detecting a temperature at a location close to said first opening, and a second temperature sensor for detecting a temperature at a location close to said second opening, and wherein when an amount of rise in said temperature detected by said first temperature sensor is greater than a predetermined value after said charging is started, said adsorption completion-detecting means judges that said adsorption of said evaporative fuel has been completed when a difference between a difference between temperature values detected by said first and second temperature sensors while said charging is being effected and a difference of same obtained immediately before said charging is started first exceeds a predetermined value, and thereafter becomes smaller than said predetermined value, and at the same time a temperature value detected by said first temperature sensor is lower than said temperature value detected by said second temperature sensor.

10. An abnormality detection system as claimed in claim 9, wherein when said amount of rise in said temperature detected by said first temperature sensor is equal to or smaller than said predetermined value after said charging is started, said adsorption completion-detecting means judges that said adsorption of said evaporative fuel has been completed when a difference between a temperature value detected by said second temperature sensor while said charging is being effected and a temperature value detected by said second temperature immediately before said charging is started exceeds a predetermined value, and at the same time said temperature value detected by said second temperature sensor is higher than said temperature value detected by said first temperature sensor by more than a predetermined value.

11. An abnormality detection system as claimed in claim 8, wherein said evaporative fuel storage device has a first opening arranged on a side of said device and communicating with said fuel tank, and a second opening arranged on another side of said device opposite to said first opening and communicating with the atmosphere, said temperature sensors comprising a first temperature sensor for detecting a temperature at a location close to said first opening, and a second temperature sensor for detecting a temperature at a location close to said second opening, and wherein said abnormality determining means judging that there is an abnormality in said evaporative fuel control system when a difference between a temperature value detected by said first temperature sensor while said purging is being effected and a temperature value thereof detected immediately before said purging is started has continuously been greater than a predetermined value over a predetermined time period after said purging was started, and at the same time a difference between a temperature value detected by said second temperature sensor while said purging is being effected and a temperature value thereof detected immediately before said purging is started has continuously been greater than said predetermined value over said predetermined time period after said purging was started.

12. In an abnormality detection system for determining abnormality in an evaporative fuel control system for an internal combustion engine having an exhaust system, an intake system, an air-fuel ratio sensor arranged in said exhaust system, fuel supply control means responsive to an output from said air-fuel ratio sensor for determining a value of an air-fuel ratio correction coefficient and controlling an amount of fuel supplied to said engine based upon the determined value of said air-fuel ratio correction coefficient, and a fuel tank, said evaporative fuel control system having an evaporative fuel storage device accommodating an adsorbent for adsorbing evaporative fuel generated in said fuel tank, and purging control means for purging said evaporative fuel from said evaporative fuel storage device to said intake system, said abnormality detection system including abnormality determining means for effecting determination of abnormality in said evaporative fuel control system, based upon the value of said air-fuel ratio connection coefficient determined when said purging is being effected by said purging control means, the improvement comprising:

temperature detecting means for detecting temperature of at least one of said adsorbent and a vicinity thereof within said evaporative fuel storage device; and abnormality determination-starting means for causing said abnormality determining means to start said abnormality determination, when an amount of rise in said temperature detected by said temperature detecting means is greater than a predetermined value.

13. An abnormality detection system as claimed in claim 12, wherein said evaporative fuel control system includes charging control means for effecting charging of said evaporative fuel from said fuel tank to said evaporative fuel storage device when said evaporative fuel is generated in said fuel tank, said abnormality determination-starting means causing said abnormality determining means to start said abnormality determination when said amount of rise in said temperature detected by said temperature detecting means is greater than said predetermined while said charging is being effected by said charging control means.

14. An abnormality detection system as claimed in claim 12, wherein said temperature detecting means comprises a plurality of temperature sensors arranged at different locations within said evaporative fuel storage device for detecting said temperature of said adsorbent or in the vicinity thereof at said different locations within said evaporative fuel storage device, said abnormality determination-starting means determining timing of starting said abnormality determination, based upon temperature values detected by said temperature sensors, amounts of rise in said temperature values, and a difference between said temperature values.

15. An abnormality detection system as claimed in claim 12, wherein said evaporative fuel storage device has a first opening arranged on a side of said device and communicating with said fuel tank, and a second opening arranged on another side of said device opposite to said first opening and communicating with the atmosphere, said temperature sensors comprising a first temperature sensor for detecting a temperature at a location close to said first opening, and a second temperature sensor for detecting a temperature at a location close to said second opening, and wherein when an amount of rise in said temperature detected by said first temperature sensor is greater than a predetermined value after said charging is started, said abnormality determination-starting means causes said abnormality determining means to start said abnormality determination when a difference between a difference between temperature values detected by said first and second temperature sensors while said charging is being effected and a difference of same obtained immediately before said charging is started first exceeds a predetermined value, and thereafter becomes smaller than said predetermined value, and at the same time a temperature value detected by said first temperature sensor is lower than said temperature value detected by said second temperature sensor.

16. An abnormality detection system as claimed in claim 15, wherein when said amount of rise in said temperature detected by said first temperature sensor is equal to or smaller than said predetermined value after said charging is started, said abnormality determination-starting means causes said abnormality determining means to start said abnormality determination when a difference between a temperature value detected by said second temperature sensor while said charging is being effected and a temperature value detected by said second temperature immediately before said charging is started exceeds a predetermined value, and at the same time said temperature value detected by said second temperature sensor is higher than said temperature value detected by said first temperature sensor by more than a predetermined value.

17. An abnormality detection system as claimed in claim 12, wherein said abnormality determining means calculates an average value of said air-fuel ratio correction coefficient when said purging is not being effected, causes said purging control means to start said purging when said engine is in a predetermined steady operating condition, and judges that there is an abnormality in said evaporative fuel control system, when the value of said air-fuel ratio correction coefficient determined while said purging is being effected has continuously been greater than a value obtained by subtracting a correction value equivalent to an amount of said purging from said average value of said air-fuel ratio correction coefficient, over a predetermined time period.

* * * * *